US008734634B2

(12) United States Patent
Bhan et al.

(10) Patent No.: US 8,734,634 B2
(45) Date of Patent: May 27, 2014

(54) METHOD FOR PRODUCING A CRUDE PRODUCT, METHOD FOR PREPARING A DILUTED HYDROCARBON COMPOSITION, CRUDE PRODUCTS, DILUENTS AND USES OF SUCH CRUDE PRODUCTS AND DILUENTS

(75) Inventors: Opinder Kishan Bhan, Katy, TX (US); Scott Lee Wellington, Bellaire, TX (US)

(73) Assignee: Shell Oil Company, Houston, TX (US)

( * ) Notice: Subject to any disclaimer, the term of this patent is extended or adjusted under 35 U.S.C. 154(b) by 407 days.

(21) Appl. No.: 12/421,775

(22) Filed: Apr. 10, 2009

(65) Prior Publication Data

US 2010/0089794 A1 Apr. 15, 2010

Related U.S. Application Data

(60) Provisional application No. 61/043,916, filed on Apr. 10, 2008.

(51) Int. Cl.
*C10M 101/02* (2006.01)

(52) U.S. Cl.
USPC ..... 208/14

(58) Field of Classification Search
USPC ..... 208/14, 15
See application file for complete search history.

(56) References Cited

U.S. PATENT DOCUMENTS

| | | | | |
|---|---|---|---|---|
| 3,902,991 | A | 9/1975 | Christensen et al. | |
| 4,002,557 | A | 1/1977 | Owen et al. | |
| 4,151,066 | A | 4/1979 | Yan et al. | |
| 5,438,039 | A * | 8/1995 | Del Bianco et al. | 507/203 |
| 5,827,803 | A * | 10/1998 | Loree | 507/137 |
| 7,591,941 | B2 * | 9/2009 | Bhan et al. | 208/108 |
| 2003/0168382 | A1 * | 9/2003 | Jois et al. | 208/213 |
| 2005/0133414 | A1 | 6/2005 | Bhan et al. | |
| 2006/0234876 | A1 * | 10/2006 | Bhan | 507/270 |
| 2007/0295645 | A1 * | 12/2007 | Brownscombe et al. | 208/91 |
| 2008/0087578 | A1 * | 4/2008 | Bhan et al. | 208/112 |
| 2009/0159489 | A1 * | 6/2009 | Lopez et al. | 208/15 |
| 2009/0188836 | A1 * | 7/2009 | Bhan et al. | 208/121 |

FOREIGN PATENT DOCUMENTS

| | | | |
|---|---|---|---|
| CA | 1163614 | 3/1984 | |
| DE | 207464 | 2/1984 | |
| EP | 0187308 | 7/1986 | C10G 45/64 |
| EP | 342759 | 11/1989 | |
| EP | 187308 | 9/1992 | |
| EP | 752460 | 1/1997 | |
| EP | 0752460 | 1/1997 | C10G 45/02 |
| EP | 1090682 | 11/2001 | |
| EP | 1260569 | 11/2002 | |

(Continued)

*Primary Examiner* — Ellen McAvoy

(57) ABSTRACT

Methods for producing a crude product, methods for preparing a diluted hydrocarbon composition, crude products, diluents and uses of such crude products and diluents are described. The method includes contacting of a hydrocarbon feed with one or more catalysts, where at least one of the catalyst includes one or more metals from Column 6 of the Periodic Table and/or one or more compounds of one or more metals from Columns 6 of the Periodic Table. The method produces a crude product having a MCR content of at most 90% of MCR content of the hydrocarbon feed and having total content of UV aromatics in a VGO fraction of the crude product which is greater than or equal to the total UV aromatics content of the hydrocarbon feed VGO fraction of the hydrocarbon feed. The crude product may be separated into two or more portions, which portions may be useful as a diluent.

1 Claim, 2 Drawing Sheets

(56) References Cited

FOREIGN PATENT DOCUMENTS

| | | | |
|---|---|---|---|
| EP | 1733787 | 12/2006 | |
| GB | 1205481 | 9/1970 | |
| GB | 1431944 | 4/1974 | |
| GB | 1431944 | 4/1976 | ..... C01B 33/26 |
| GB | 2060681 | 5/1981 | |
| GB | 2072697 | 10/1981 | |
| GB | 2167430 | 5/1986 | |
| WO | 0232570 | 4/2002 | |
| WO | 2006060354 | 6/2006 | |
| WO | 2006110546 | 10/2006 | |
| WO | 2006110660 | 10/2006 | |
| WO | 2007064015 | 6/2007 | |
| WO | 2008016969 | 2/2008 | |
| WO | 2008016971 | 2/2008 | |
| WO | 2008045755 | 4/2008 | |

* cited by examiner

METHOD FOR PRODUCING A CRUDE PRODUCT, METHOD FOR PREPARING A DILUTED HYDROCARBON COMPOSITION, CRUDE PRODUCTS, DILUENTS AND USES OF SUCH CRUDE PRODUCTS AND DILUENTS

This patent application claims the benefit of U.S. Provisional Application 61/043,916, filed Apr. 10, 2008, which is incorporated herein by reference

FIELD OF THE INVENTION

The present invention relates to a method for producing a crude product, a method for preparing a diluted hydrocarbon composition, crude products, diluents and uses of such crude products and diluents.

BACKGROUND OF THE INVENTION

Crudes that have one or more unsuitable properties that do not allow the crudes to be economically transported or processed using conventional facilities are commonly referred to as "disadvantaged crudes".

One way of making such disadvantaged crudes transportable may be by converting components such as micro-carbon residue (MCR) of the disadvantaged crude.

Conventional methods of converting MCR include contacting the disadvantaged crude at elevated temperatures and pressure with hydrogen in the presence of a catalyst.

During such contacting, ultra-violet aromatic hydrocarbons (UV aromatics) in the disadvantaged crude may be hydrogenated to form saturated hydrocarbons. The formation of saturated hydrocarbons may change the solubility properties of various hydrocarbons in the disadvantaged crudes (for example, solubility properties of polar compounds such as asphaltenes and/or high molecular weight compounds). The change in solubility may disadvantageously result in phase separation of some of the components during processing. Formation of two phases during processing may also disadvantageously reduce the life of conventional catalysts and/or disadvantageously affect the efficiency of the process.

Additionally, processing at high temperatures and pressures tends to promote formation of coke and/or other precipitates. Coke and/or other precipitates may accumulate in pores of the catalyst, reducing the activity of the catalyst and the life of the catalyst.

Another way of making disadvantaged crudes transportable may be by mixing the crude with a diluent.

It would be desirable to have a method and/or a catalyst for converting components that contribute to micro-carbon residue (MCR) content in the disadvantaged crude whilst maintaining solubility of high molecular weight compounds in the disadvantaged crude/products mixture formed during processing. Therefore it would be desirable to have a method for converting components that contribute to micro-carbon residue (MCR) content in the disadvantaged crude whilst maintaining or increasing the content of ultra-violet aromatic hydrocarbons. It would further be advantageous if the catalyst could be used at elevated temperatures and minimal pressures with minimal formation of coke and/or other precipitates. It would further be advantageous if such a catalyst would, additionally, have a longer useful life than conventional catalysts.

In addition it would be advantageous if a portion of the product could be separated and used as a diluent for other hydrocarbon compositions such as for example other disadvantaged crudes or another portion of the disadvantaged crude.

U.S. Pat. No. 4,225,421 to Hensley, U.S. Pat. No. 5,928,499 to Sherwood Jr. et al., U.S. Pat. No. 6,554,994 to Reynolds et al., U.S. Pat. No. 6,436,280 to Harle et al., U.S. Pat. No. 5,928,501 to Sudhakar et al., U.S. Pat. No. 4,937,222 to Angevine et al., U.S. Pat. No. 4,886,594 to Miller, U.S. Pat. No. 4,746,419 to Peck et al., U.S. Pat. No. 4,548,710 to Simpson, U.S. Pat. No. 4,525,472 to Morales et al., U.S. Pat. No. 4,499,203 to Toulhoat et al., U.S. Pat. No. 4,389,301 to Dahlberg et al., and U.S. Pat. No. 4,191,636 to Fukui et al. describe various processes, systems, and catalysts for processing crudes and/or disadvantaged crudes.

U.S. Published Patent Application Nos. 20050133414 through 20050133418 to Bhan et al.; 20050139518 through 20050139522 to Bhan et al., 20050145543 to Bhan et al., 20050150818 to Bhan et al., 20050155908 to Bhan et al., 20050167320 to Bhan et al., 20050167324 through 20050167332 to Bhan et al., 20050173301 through 20050173303 to Bhan et al., 20060060510 to Bhan; 20060231465 to Bhan; 20060231456 to Bhan; 20060234876 to Bhan; 20060231457 to Bhan and 20060234877 to Bhan; 20070000810 to Bhan et al.; 20070000808 to Bhan; 20070000811 to Bhan et al.; International Publication Nos. WO 02/32570, WO 2008/016969, and WO 2008/106979 to Bhan; and U.S. patent application Ser. Nos. 11/866,909; 11/866,916; 11/866,921 through 11/866,923; 11/866,926; 11/866,929 and 11/855,932 to Bhan et al., filed Oct. 3, 2007, are related patent applications and describe various processes, systems, and catalysts for processing crudes and/or disadvantaged crudes.

International Application Publication No. WO 02/32570 to Bhan describes a catalyst for hydrodemetallation of a heavy hydrocarbon stream. The catalyst has a bimodal pore structure and is prepared by mixing at least 20% alumina fines and metal from Column 6 and Column 10 of the Periodic Table. The catalyst was found to be effective at removing metals from heavy oil fractions containing high concentrations of nickel and vanadium while exhibiting good stability. This publication does not describe ultra-violet aromatics content of the product relative to the ultra-violet aromatic content of the feed.

U.S. patent application Ser. No. 11/866,921 to Bhan et al. filed Oct. 3, 2007 describes, in Example 27, contact of a hydrocarbon feed (crude from Peace River) with a Molybdenum catalyst containing mineral oxide fines to produce a crude product that has a residue content of 20.2 wt %. This publication does not describe ultra-violet aromatics content of the product relative to the ultra-violet aromatic content of the feed.

It would be desirable to have a method to economically convert disadvantaged crudes to transportable crude products. Therefore, it would further be desirable to be able to reduce at least a portion of the components that contribute to micro-carbon residue content while maintaining the stability of the crude and/or product by maintaining or increasing UV aromatics content. It would further be advantageous is large amounts of disadvantaged crudes can be made transportable with limited processing.

SUMMARY OF THE INVENTION

It has now been found that a hydrocarbon feed can be contacted with a catalyst to produce a product that has a reduced MCR content and an equal or increased ultra-violet aromatics content relative to the MCR content and ultra-violet aromatics content of the feed. Furthermore it has now been found that by separating a portion, such as for example a portion comprising a vacuum gas oil (VGO) fraction having a boiling range distribution between 343° C. and 538° C. from the product, a composition can be obtained with a high UV aromatics content that is especially useful as a diluent for other hydrocarbon compositions such as for example further disadvantaged crude.

Accordingly, in some embodiments, the invention provides a method of producing a crude product, comprising:

contacting a hydrocarbon feed with one or more catalysts to produce a total product that includes the crude product, wherein the hydrocarbon feed has a MCR content of at least 0.1 grams per gram of hydrocarbon feed, and at least 0.0001 grams of hydrocarbons of a vacuum gas oil ("VGO") fraction having a boiling range distribution between 343° C. and 538° C. at 0.101 MPA per gram of hydrocarbon feed, wherein the VGO fraction comprises at least 0.05 grams of UV aromatics per gram of VGO fraction; and at least one of the catalysts comprises one or more metals from Column 6 of the Periodic Table and/or one or more compounds of one or more metals from Columns 6 of the Periodic Table; and controlling contacting conditions at a partial pressure of hydrogen of least 3 MPa and a temperature of least 200° C. to produce the crude product; the crude product having a MCR content of at most 90% of the hydrocarbon feed MCR content and the total UV aromatics content in the VGO fraction of the crude product is greater than or equal to the total UV aromatics content in the VGO fraction of the hydrocarbon feed, and wherein MCR content is as determined by ASTM Method D4530, boiling range distribution is as determined by ASTM Method D5307.

Further, in some embodiments, the invention provides a method for preparing a diluted hydrocarbon composition comprising:

a) contacting a hydrocarbon feed with one or more catalysts to produce a crude product; wherein the hydrocarbon feed comprises at least 0.0001 grams of hydrocarbons of a vacuum gas oil fraction having a boiling range distribution between 343° C. and 538° C. at 0.101 MPA per gram of hydrocarbon feed, wherein the vacuum gas oil fraction (VGO) fraction comprises at least 0.05 grams of UV aromatics per gram of VGO fraction; and wherein the boiling range distribution is as determined by ASTM Method D5307;

wherein at least one of the catalysts comprises one or more metals from Column 6 of the Periodic Table and/or one or more compounds of one or more metals from Columns 6 of the Periodic Table; and wherein contacting conditions are controlled at a partial pressure of hydrogen of least 3 MPa and a temperature of least 200° C.;

b) separating the crude product into two or more portions;

c) mixing at least part of at least one portion obtained in step b) with a dilutable hydrocarbon composition to produce a diluted hydrocarbon composition.

Further, in some embodiments, the invention provides a hydrocarbon composition made by:

contacting a hydrocarbon feed with one or more catalysts to produce a total product that includes the crude product, wherein the hydrocarbon feed has a MCR content of at least 0.1 grams per gram of hydrocarbon feed, and at least 0.0001 grams of hydrocarbons of a vacuum gas oil ("VGO") portion having a boiling range distribution between 343° C. and 538° C. at 0.101 MPA per gram of hydrocarbon feed, wherein the VGO fraction comprises at least 0.05 grams of UV aromatics per gram of VGO fraction; and at least one of the catalysts comprises one or more metals from Column 6 of the Periodic Table and/or one or more compounds of one or more metals from Columns 6 of the Periodic Table; and controlling contacting conditions at a partial pressure of hydrogen of least 3 MPa and a temperature of least 200° C. to produce the crude product; the crude product having a MCR content of at most 90% of the hydrocarbon feed MCR content and wherein the total UV aromatics content in a VGO fraction of the crude product is greater than or equal to the total UV aromatics content in the VGO fraction of the hydrocarbon feed, and wherein MCR content is as determined by ASTM Method D4530.

Further, in some embodiments, the invention provides a transportation fuel comprising one or more distillate fractions produced from the hydrocarbon composition mentioned above and/or a diluent produced from the crude product mentioned above.

Further, in some embodiments, the invention provides a diluent obtained by a) contacting a crude feed with hydrogen and one or more catalysts to produce a crude product; wherein the crude feed comprises at least 0.0001 grams of hydrocarbons of a vacuum gas oil fraction having a boiling range distribution between 343° C. and 538° C. at 0.101 MPA per gram of hydrocarbon feed, wherein the vacuum gas oil fraction comprises at least 0.05 grams of total UV aromatics per gram of VGO fraction; and wherein the boiling range distribution is as determined by ASTM Method D5307;

wherein at least one of the catalysts comprises one or more metals from Column 6 of the Periodic Table and/or one or more compounds of one or more metals from Columns 6 of the Periodic Table; and wherein contacting conditions are controlled at a partial pressure of hydrogen of least 3 MPa and a temperature of least 200° C.;

b) separating the crude product into two or more portions, c) producing a diluent from at least part of at least one portion obtained in step b).

Further, in some embodiments, the invention provides a hydrocarbon composition, comprising:

a Ni/Fe/V content of between 100 wtppm and 300 wtppm as determined by ASTM Method D5708;

at least 0.1 grams of residue per gram of crude product as determined by ASTM Method D5307;

at least 0.2 grams of hydrocarbons having a boiling range distribution between 204° C. and 343° C. at 0.101 MPa per gram of crude product as determined by ASTM Method D5307;

at least 0.3 grams of hydrocarbons of a vacuum gas oil ("VGO") portion having a boiling range distribution between 343° C. and 538° C. at 0.101 MPA per gram of crude product, wherein the VGO fraction comprises at least 0.2 grams of total UV aromatics per gram of crude product VGO fraction; and wherein the hydrocarbon composition has a viscosity at 37.8° C. of at most 100 cSt, wherein viscosity is as determined by ASTM Method D445.

Further, in some embodiments, the invention provides a hydrocarbon composition, having a boiling range distribution between 650° F. and 1000° F. (343° C. and 538° C.) at 0.101 MP comprising at least 20 wt % grams of UV aromatics, which composition comprises at least 0.1 wt % mono-aromatics at least 0.1 wt % di-aromatics at least 0.1 wt % tri-aromatics; and at least 0.1 wt % tetra-aromatics Further, in some embodiments, the invention provides a method of producing a crude product, comprising:

contacting a hydrocarbon feed with one or more catalysts to produce a total product that includes the crude product, wherein the hydrocarbon feed has a MCR content of at least 0.1 grams per gram of hydrocarbon feed, and at least 0.0001 grams of hydrocarbons of a hydrocarbon portion having a boiling range distribution between 260° C. and 594° C. at 0.101 MPA per gram of hydrocarbon feed, wherein the hydrocarbon portion having a boiling range distribution between 260° C. and 594° C. at 0.101 comprises at least 0.05 grams of UV aromatics per gram of said hydrocarbon portion; and at least one of the catalysts comprises one or more metals from Column 6 of the Periodic Table and/or one or more compounds of one or more metals from Columns 6 of the Periodic Table; and controlling contacting conditions at a partial pressure of hydrogen of least 3 MPa and a temperature of least 200° C. to produce the crude product; the crude product having a MCR content of at most 90% of the hydrocarbon feed MCR content and wherein a total UV aromatics content in the hydrocarbon portion having a boiling range distribution between 260° C. and 594° C. at 0.101 of the crude product is greater than or equal to the total UV aromatics content in said hydrocarbon portion of the hydrocarbon feed, and wherein MCR content is as determined by ASTM Method D4530, boiling range distribution is as determined by ASTM Method D5307.

In addition, the invention provides a transportation fuel comprising the hydrocarbon composition mentioned above and/or a diluent/crude feed mixture comprising the hydrocarbon composition mentioned above.

Further the invention provides a method wherein a hydrocarbon composition, such as a crude feed, is diluted with a diluent, which diluents has a boiling range distribution between 650° F. and 1000° F. (343° C. and 538° C.) at 0.101 MP, which diluent comprises at least 20 wt % grams of UV aromatics, and which diluent comprises at least 0.1 wt % mono-aromatics at least 0.1 wt % di-aromatics at least 0.1 wt % tri-aromatics; and at least 0.1 wt % tetra-aromatics.

BRIEF DESCRIPTION OF THE DRAWINGS

Advantages of the present invention will become apparent to those skilled in the art with the benefit of the following detailed description and upon reference to the accompanying drawings in which.

DETAILED DESCRIPTION OF THE INVENTION

Figure 1:
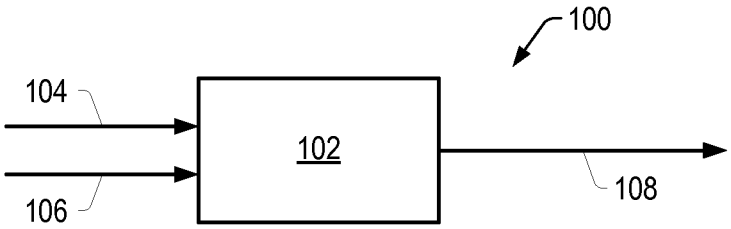
FIG. 1 is a schematic of an embodiment of a contacting system.

It has now been found that a hydrocarbon feed can be contacted with a hydrogen source in the presence of a catalyst to produce a product that has a changed MCR content and a similar or increased ultra-violet aromatics content relative to the MCR content and ultra-violet aromatic content of the hydrocarbon feed. It has been advantageously found that a change in the ultra-violet aromatic content of the hydrocarbon feed may enhance stability of the disadvantaged feed/total product mixture during contacting. Certain embodiments of the inventions are described herein in more detail.

Hydrocarbon feeds having viscosities that inhibit the hydrocarbon feed from being transported and/or pumped may be contacted with conventional catalyst at elevated hydrogen pressures (for example, at least 7 MPa, at least 10 MPa or at least 15 MPa) to produce products that are more fluid. At elevated hydrogen pressures coke formation is inhibited, thus the properties of the hydrocarbon feed may be changed with minimal coke production. Since reduction of viscosity, residue and $C_5/C_7$ asphaltenes is not dependent on hydrogen pressure, reduction of these properties may not occur unless the contacting temperature is at least 300° C. For some hydrocarbon feeds, temperatures of at least 350° C. may be required to reduce desired properties of the hydrocarbon feed to produce a product that meets the desired specifications. At increased temperatures coke formation may occur, even at elevated hydrogen pressures. As the properties of the hydrocarbon feed are changed, the P-value of the hydrocarbon feed/total product may decrease below 1.0 and/or sediment may form, causing the product mixture to become unstable. Elevated hydrogen pressures require large amounts of hydrogen. The present invention advantageously provides a process capable of reducing properties at low pressure and minimal temperature. The processes may even be operated at pressures of at most 7 MPa and temperatures of at most 430° C. without producing substantial amounts of sediment and/or coke.

Terms used herein are defined as follows.

"ASTM" refers to American Standard Testing and Materials.

"API gravity" refers to API gravity at 15.5° C. (60° F.). API gravity is as determined by ASTM Method D6822.

Atomic hydrogen percentage and atomic carbon percentage of the hydrocarbon feed and the crude product are as determined by ASTM Method D5291.

Boiling range distributions for the hydrocarbon feed, the total product, and/or the crude product are as determined by ASTM Method D5307 unless otherwise mentioned.

"$C_5$ asphaltenes" refers to asphaltenes that are insoluble in n-pentane. $C_5$ asphaltenes content is as determined by ASTM Method D2007.

"$C_7$ asphaltenes" refers to asphaltenes that are insoluble in n-heptane. $C_7$ asphaltenes content is as determined by ASTM Method D3279.

"Column X metal(s)" refers to one or more metals of Column X of the Periodic Table and/or one or more compounds of one or more metals of Column X of the Periodic Table, in which X corresponds to a column number (for example, 1-12) of the Periodic Table. For example, "Column 6 metal(s)" refers to one or more metals from Column 6 of the Periodic Table and/or one or more compounds of one or more metals from Column 6 of the Periodic Table.

"Column X element(s)" refers to one or more elements of Column X of the Periodic Table, and/or one or more compounds of one or more elements of Column X of the Periodic Table, in which X corresponds to a column number (for example, 13-18) of the Periodic Table. For example, "Column 15 element(s)" refers to one or more elements from Column 15 of the Periodic Table and/or one or more compounds of one or more elements from Column 15 of the Periodic Table.

In the scope of this application, weight of a metal from the Periodic Table, weight of a compound of a metal from the Periodic Table, weight of an element from the Periodic Table, or weight of a compound of an element from the Periodic Table is calculated as the weight of metal or the weight of element. For example, if 0.1 grams of $MoO_3$ is used per gram of catalyst, the calculated weight of the molybdenum metal in the catalyst is 0.067 grams of molybdenum metal per gram of catalyst.

"Content" refers to the weight of a component in a substrate (for example, a hydrocarbon feed, a total product, or a crude product) expressed as weight fraction or weight percentage based on the total weight of the substrate. "Wtppm" refers to parts per million by weight.

"Crude feed" refers to a crude and/or disadvantaged crude that is to be treated herein.

"Crude feed/total product mixture" or "hydrocarbon feed/total product" refers to the mixture that contacts the catalyst during processing.

"Distillate" refers to hydrocarbons with a boiling range distribution between 182° C. (360° F.) and 343° C. (650° F.) at 0.101 MPa. Distillate content is as determined by ASTM Method D5307.

"Heteroatoms" refers to oxygen, nitrogen, and/or sulfur contained in the molecular structure of a hydrocarbon. Heteroatoms content is as determined by ASTM Methods E385 for oxygen, D5762 for total nitrogen, and D4294 for sulfur. "Total basic nitrogen" refers to nitrogen compounds that have a pKa of less than 40. Basic nitrogen ("bn") is as determined by ASTM Method D2896.

"Hydrocarbon feed" refers to a feed that includes hydrocarbons. Hydrocarbon feed may include, but is not limited to, crudes, disadvantaged crudes, stabilized crudes, bitumen, crude oil, pitch, hydrocarbons obtained from refinery processes, or mixtures thereof.

"Hydrogen source" refers to a source of hydrogen and includes hydrogen gas, and/or a compound and/or compounds, that when in the presence of a hydrocarbon feed and the catalyst, react to provide hydrogen. A hydrogen source may include, but is not limited to, hydrogen gas, hydrocarbons (for example, $C_1$ to $C_4$ hydrocarbons such as methane, ethane, propane, and butane), water, or mixtures thereof. A mass balance may be conducted to assess the net amount of hydrogen provided.

"LHSV" refers to a volumetric liquid feed rate per total volume of catalyst and is expressed in hours ($h^{-1}$). Total volume of catalyst is calculated by summation of all catalyst volumes in the contacting zones, as described herein.

"Liquid mixture" refers to a composition that includes one or more compounds that are liquid at standard temperature and pressure (25° C., 0.101 MPa, hereinafter referred to as "STP"), or a composition that includes a combination of one of more compounds that are liquid at STP with one or more compounds that are solids at STP.

"Periodic Table" refers to the Periodic Table as specified by the International Union of Pure and Applied Chemistry (IUPAC), November 2003.

"Metals in metal salts of organic acids" refer to alkali metals, alkaline-earth metals, zinc, arsenic, chromium, or combinations thereof. A content of metals in metal salts of organic acids is as determined by ASTM Method D1318.

"Micro-Carbon Residue" ("MCR") content refers to a quantity of carbon residue remaining after evaporation and pyrolysis of a substrate. MCR content is as determined by ASTM Method D4530.

"Mineral-oxide fines" refers to oxides of metals ground to desired particle size. Examples of oxides of metals include, but are not limited to, alumina, silica, silica-alumina, titanium oxide, zirconium oxide, magnesium oxide, or mixtures thereof.

"Molybdenum content in the hydrocarbon feed" refers to the content of molybdenum in the feed. The molybdenum content includes the amount of inorganic molybdenum and organomolybdenum in the feed. Molybdenum content in the hydrocarbon feed is as determined by ASTM Method D5807.

"Ni/V/Fe" refers to nickel, vanadium, iron, or combinations thereof.

"Ni/V/Fe content" refers to the content of nickel, vanadium, iron, or combinations thereof. The Ni/V/Fe content includes inorganic nickel, vanadium and iron compounds and/or organonickel, organovanadium, and organoiron compounds. The Ni/V/Fe content is as determined by ASTM Method D5708.

"$Nm^3/m^3$" refers to normal cubic meters of gas per cubic meter of hydrocarbon feed.

"Non-condensable gas" refers to components and/or mixtures of components that are gases at STP.

"Organometallic" refers to compound that includes an organic compound bonded or complexed with a metal of the Periodic Table. "Organometallic content" refers to the total content of metal in the organometallic compounds. Organometallic content is as determined by ASTM Method D5807.

"P (peptization) value" or "P-value" refers to a numeral value, which represents the flocculation tendency of asphaltenes in the hydrocarbon feed. P-Value is as determined by ASTM Method D7060.

"Pore diameter", "median pore diameter", and "pore volume" refer to pore diameter, median pore diameter, and pore volume, as determined by ASTM Method D4284 (mercury porosimetry at a contact angle equal to 140°). A Micromeritics® A9220 instrument (Micromeritics Inc., Norcross, Ga., U.S.A.) may be used to determine these values.

"Sediment" refers to impurities and/or coke that are insoluble in the hydrocarbon feed/total product mixture. Sediment is as determined by ASTM Method D4807. Sediment may also be determined by the Shell Hot Filtration Test ("SHFST") as described by Van Kernoort et al. in the Jour. Inst. Pet., 1951, pages 596-604.

"SCFB" refers to standard cubic feet of gas per barrel of hydrocarbon feed.

"Surface area" of a catalyst is as determined by ASTM Method D3663.

"VGO" refers to hydrocarbons with a boiling range distribution between 343° C. (650° F.) and 538° C. (1000° F.) at 0.101 MPa. VGO content is as determined by ASTM Method D5307.

"Viscosity" refers to kinematic viscosity at 37.8° C. (100° F.). Viscosity is as determined using ASTM Method D445.

"Wtppm" refers to parts per million by weight.

"UV aromatics" refer to hydrocarbons that include at least one benzene ring. "Mono-aromatics" refer to hydrocarbon compounds that include one benzene ring. "Di-aromatics" refer to hydrocarbon compounds that include two fused benzene rings (for example, naphthalene). "Tri-aromatics refer to hydrocarbon compounds that include three fused benzene rings (for example, phenanthrenes). "Tetra-aromatics" refer to hydrocarbon compounds that include 4 fused benzene rings (for example, tetraphenes). UV aromatics is as determined by the method described by Burdett et al. in "Determination of Aromatic Hydrocarbons in Lubricating Oil Fractions by Far Ultra-Violet Absorption Spectroscopy" in "Molecular Spectroscopy: Report of a Conference Organized by The Spectroscopic Panel of the Hydrocarbon Research Group of the Institute of Petroleum and Held in London, 28-29 Oct., 1954", pages 30-41.

"Total UV aromatics" or "total UV aromatics content" refers to the total content of UV aromatics in any specific composition such as for example a feed, product or product portion "Hydrocarbon feed" refers to a feed that includes hydrocarbons. Hydrocarbon feed may include, but is not limited to, crudes, disadvantaged crudes, stabilized crudes, bitumen, crude oil, pitch, hydrocarbons obtained from refinery processes, or mixtures thereof. Examples of hydrocarbon feed obtained from refinery processes include, but are not limited to, long residue, short residue, naphtha, gasoil and/or hydrocarbons boiling above 538° C. (1000° F.), or mixtures thereof.

In one embodiment the hydrocarbon feed is a crude, herein also referred to as crude feed. Crude or crude feed refers to a feed of hydrocarbons which has been produced and/or retorted from hydrocarbon containing formations and which has not yet been distilled and/or fractionally distilled in a treatment facility to produce multiple components with specific boiling range distributions, such as atmospheric distillation methods and/or vacuum distillation methods. Crudes may be solid, semi-solid, and/or liquid. Crudes may include for example coal, bitumen, tar sands or crude oil. The crude or crude feed may be stabilized to form a stabilized crude, also referred to as stabilized crude feed. Stabilization may include, but is not limited to, removal of non-condensable gases, water, salts, or combinations thereof from the crude to form a stabilized crude. Such stabilization may often occur at, or proximate to, the production and/or retorting site.

Stabilized crudes have not been distilled and/or fractionally distilled in a treatment facility to produce multiple components with specific boiling range distributions (for example, naphtha, distillates, VGO, and/or lubricating oils). Distillation includes, but is not limited to, atmospheric distillation methods and/or vacuum distillation methods. Undistilled and/or unfractionated stabilized crudes may include components that have a carbon number above 4 in quantities of at least 0.5 grams of components per gram of crude. Examples of stabilized crudes include whole crudes, topped crudes, desalted crudes, desalted topped crudes, or combinations thereof. "Topped" refers to a crude that has been treated such that at least some of the components that have a boiling point below 35° C. at 0.101 MPa (95° F. at 1 atm) have been removed. Topped crudes may have a content of at most 0.1 grams, at most 0.05 grams, or at most 0.02 grams of such components per gram of the topped crude.

Some stabilized crudes have properties that allow the stabilized crudes to be transported to conventional treatment facilities by transportation carriers (for example, pipelines, trucks, or ships). Other crudes have one or more unsuitable properties that render them disadvantaged.

Disadvantaged crudes may be unacceptable to a transportation carrier and/or a treatment facility, thus imparting a low economic value to the disadvantaged crude. The economic value may be such that a reservoir that includes the disadvantaged crude is deemed too costly to produce, transport, and/or treat.

The properties of the hydrocarbon feed, such as for example the crudes or disadvantaged crudes may vary widely.

The hydrocarbon feed, such as for example a crude feed, may have a viscosity of at least 10 cSt at 37.8° C., at least 100 cSt, at least 1000 cSt, or at least 2000 cSt at 37.8° C.

The hydrocarbon feed, such as for example a crude feed, may have an API gravity of at most 19, at most 15, or at most 10. It may further have an API gravity of at least 5.

The hydrocarbon feed, such as for example a crude feed, may have a total Ni/V/Fe content of at least 0.00002 grams or at least 0.0001 grams of Ni/V/Fe per gram of hydrocarbon feed;

The hydrocarbon feed, such as for example a crude feed, may have a total heteroatoms content of at least 0.005 grams of heteroatoms per gram of hydrocarbon feed;

The hydrocarbon feed, such as for example a crude feed, may have a residue content of at least 0.01 grams of residue per gram of hydrocarbon feed. In some embodiments, the hydrocarbon or crude feed may include, per gram of feed, at least 0.2 grams of residue, at least 0.3 grams of residue, at least 0.5 grams of residue, or at least 0.9 grams of residue.

The hydrocarbon feed, such as for example a crude feed, may have per gram of hydrocarbon feed, a sulfur content of at least 0.005, at least 0.01, or at least 0.02 grams.

The hydrocarbon feed, such as for example a crude feed, may have a $C_5$ asphaltenes content of at least 0.04 grams or at least 0.08 grams of $C_5$ asphaltenes per gram of hydrocarbon feed; and/or at least 0.02 grams or at least 0.04 grams of $C_7$ asphaltenes per gram of hydrocarbon feed.

The hydrocarbon feed, such as for example a crude feed, may have a MCR content of at least 0.002 grams of MCR per gram of hydrocarbon feed The hydrocarbon feed, such as for example a crude feed, may have a content of metals in metal salts of organic acids of at least 0.00001 grams of metals per gram of hydrocarbon feed The hydrocarbon feed, such as for example a crude feed, may further have a molybdenum content of at least 0.1 wtppm;

The hydrocarbon feed, such as for example a crude feed, may further have any kind of combination of the above mentioned properties.

The hydrocarbon feed, such as for example a crude feed, may include per gram of feed: at least 0.001 grams, at least 0.005 grams, or at least 0.01 grams of hydrocarbons with a boiling range distribution between 95° C. and 200° C. at 0.101 MPa; at least 0.001 grams, at least 0.005 grams, or at least 0.01 grams of hydrocarbons with a boiling range distribution between 200° C. and 300° C. at 0.101 MPa; at least 0.001 grams, at least 0.005 grams, or at least 0.01 grams of hydrocarbons with a boiling range distribution between 300° C. and 400° C. at 0.101 MPa; and at least 0.001 grams, at least 0.005 grams, or at least 0.01 grams of hydrocarbons with a boiling range distribution between 400° C. and 650° C. at 0.101 MPa.

In a further embodiment, the hydrocarbon feed, such as for example a crude feed, may include per gram of feed: at least 0.001 grams, at least 0.005 grams, or at least 0.01 grams of hydrocarbons with a boiling range distribution of at most 100° C. at 0.101 MPa; at least 0.001 grams, at least 0.005 grams, or at least 0.01 grams of hydrocarbons with a boiling range distribution between 100° C. and 200° C. at 0.101 MPa; at least 0.001 grams, at least 0.005 grams, or at least 0.01 grams of hydrocarbons with a boiling range distribution between 200° C. and 300° C. at 0.101 MPa; at least 0.001 grams, at least 0.005 grams, or at least 0.01 grams of hydrocarbons with a boiling range distribution between 300° C. and 400° C. at 0.101 MPa; and at least 0.001 grams, at least 0.005 grams, or at least 0.01 grams of hydrocarbons with a boiling range distribution between 400° C. and 650° C. at 0.101 MPa.

Some hydrocarbon feeds or crude feeds may include, per gram of feed, at least 0.001 grams, at least 0.005 grams, or at least 0.01 grams of hydrocarbons with a boiling range distribution of at most 100° C. at 0.101 MPa, in addition to higher boiling components. Typically, the disadvantaged crude has, per gram of disadvantaged crude, a content of such hydrocarbons of at most 0.2 grams or at most 0.1 grams.

Some hydrocarbon feeds or crude feeds may include, per gram of feed, at least 0.001 grams, at least 0.005 grams, or at least 0.01 grams of hydrocarbons with a boiling range distribution of at least 200° C. at 0.101 MPa.

Some hydrocarbon feeds or crude feeds may include, per gram of feed, at least 0.001 grams, at least 0.005 grams, or at least 0.01 grams of hydrocarbons with a boiling range distribution of at least 650° C.

Examples of crudes that might be treated using the processes described herein include, but are not limited to, crudes from of the following regions of the world: U.S. Gulf Coast and southern California, Canada Tar sands, Brazilian Santos and Campos basins, Egyptian Gulf of Suez, Chad, United Kingdom North Sea, Angola Offshore, Chinese Bohai Bay, Venezuelan Zulia, Malaysia, and Indonesia Sumatra. The hydrocarbon feed may be topped, as described herein.

Treatment of disadvantaged crudes may enhance the properties of the disadvantaged crudes such that the crudes are acceptable for transportation and/or treatment.

The crude product resulting from treatment of the crude feed, as described herein, may be suitable for transporting and/or treatment. Properties of the crude product produced as described herein are closer to the corresponding properties of West Texas Intermediate crude than the crude feed, or closer to the corresponding properties of Brent crude, than the crude feed, thereby enhancing the economic value of the crude feed. Such crude product may be refined with less or no pre-treatment, thereby enhancing refining efficiencies. Pre-treatment may include desulfurization, demetallization, and/or atmospheric distillation to remove impurities.

For example, in some embodiments, removal of at least a portion of the organometallic compounds and/or metals from the hydrocarbon feed is performed before the hydrocarbon feed is contacted with other catalysts. For example, a small amount of organomolybdenum (for example, at most 50 wtppm, at most 20 wtppm, or at most 10 wtppm) in a hydrocarbon feed may reduce the activity of a catalyst upon contact of the hydrocarbon feed with the catalyst.

Treatment of a hydrocarbon feed in accordance with embodiments described herein may include contacting the hydrocarbon feed with the catalyst(s) in a contacting zone and/or combinations of two or more contacting zones. In a contacting zone, at least one property of a hydrocarbon feed may be changed by contact of the hydrocarbon feed with one or more catalysts relative to the same property of the hydrocarbon feed. Contacting may be performed in the presence of a hydrogen source. In some embodiments the hydrogen source is hydrogen. In some embodiments, the hydrogen source is one or more hydrocarbons that, under certain contacting conditions, react to provide relatively small amounts of hydrogen to compound(s) in the hydrocarbon feed.

FIG. 1 is a schematic of contacting system 100 that includes contacting zone 102. The hydrocarbon feed enters upstream contacting zone 102 via hydrocarbon feed conduit 104. A contacting zone may be a reactor, a portion of a reactor, multiple portions of a reactor, or combinations thereof. Examples of a contacting zone include a stacked bed reactor, a fixed bed reactor, an ebullating bed reactor, a continuously stirred tank reactor ("CSTR"), a fluidized bed reactor, a spray reactor, and a liquid/liquid contactor. Configuration of one or more contacting zones is described in U.S. Published Patent Application No. 20050133414 to Bhan et al., which is incorporated herein by reference. In certain embodiments, the contacting system is on or coupled to an offshore facility. Contact of the hydrocarbon feed with catalyst(s) in contacting system 100 may be a continuous process or a batch process.

The contacting zone may include one or more catalysts (for example, two catalysts). In some embodiments, contact of the hydrocarbon feed with a first catalyst of the two catalysts may reduce a portion of the components that contribute to microcarbon residue content of the hydrocarbon feed. The first catalyst may also change the UV aromatics content of the crude product relative to the hydrocarbon feed. The change in UV aromatics content may enhance stability of the hydrocarbon feed/total product mixture during processing. Subsequent contact of the changed hydrocarbon feed with the second catalyst may decrease viscosity and/or increases API gravity. In other embodiments, viscosity, residue content, $C_5$ asphaltenes content, $C_7$ asphaltenes content, organometallic content, or combinations of these properties of the crude product change by at least 10% relative to the same properties of the hydrocarbon feed after contact of the hydrocarbon feed with one or more catalysts. The first catalyst may be upstream or downstream of the second catalyst. In some embodiments, the first catalyst is upstream of the second catalyst, such that a sufficiently stable feed/product mixture is forwarded to the second catalyst.

In some embodiments, the catalyst may be positioned upstream of a series of catalysts. Such positioning of the catalyst may allow removal of high molecular weight contaminants, while maintaining the stability of the hydrocarbon feed/total product mixture.

In some embodiments, one or more commercially available catalyst(s) may be positioned downstream of the catalyst of the application to reduce selected properties of the feed. In some embodiments, the catalyst may be positioned upstream and/or between a series of catalysts. For example, a demetallization catalyst may be positioned downstream of the catalyst of the application to reduce the Ni/V/Fe content of the crude produce as compared to Ni/V/Fe of the feed. A desulfurization catalyst may be positioned downstream of the demetallization catalyst to reduce the heteroatom content of the crude product as compared to the heteroatom content of the feed. Examples of commercial catalysts include HDS3; HDS22; HDN60; C234; C311; C344; C411; C424; C344; C444; C447; C454; C448; C524; C534; DC2531; DN120; DN130; DN140; DN190; DN200; DN800; DN2118; DN2318; DN3100; DN3110; DN3300; DN3310; DN3330; RC400; RC410; RN412; RN400; RN420; RN440; RN450; RN650; RN5210; RN5610; RN5650; RM430; RM5030; Z603; Z623; Z673: Z703; Z713; Z723; Z753; and Z763, which are available from CRI International, Inc. (Houston, Tex., U.S.A.).

In certain embodiments, a volume of catalyst in the contacting zone is in a range from 10 vol % to 60 vol %, 20 vol % to 50 vol %, or 30 vol % to 40 vol % of a total volume of hydrocarbon feed in the contacting zone. In some embodiments, a slurry of catalyst and hydrocarbon feed may include from 0.001 grams to 10 grams, 0.005 grams to 5 grams, or 0.01 grams to 3 grams of catalyst per 100 grams of hydrocarbon feed in the contacting zone.

Contacting conditions in the contacting zone may include, but are not limited to, temperature, pressure, hydrogen source flow, hydrocarbon feed flow, or combinations thereof. Contacting conditions in some embodiments are controlled to produce a crude product with specific properties. Temperature in the contacting zone may range from 50° C. to 500° C., from 60° C. to 440° C., from 70° C. to 430° C., or from 80° C. to 420° C. In some embodiments, temperature in a contacting zone may range from 350° C. to 450° C., from 360° C. to 440° C., or from 370° C. to 430° C. LHSV of the hydrocarbon feed will generally range from 0.1 $h^{-1}$ to 30 $h^{-1}$, 0.4 $h^{-1}$ to 25 $h^{-1}$, 0.5 $h^{-1}$ to 20 $h^{-1}$, 1 $h^{-1}$ to 15 $h^{-1}$, 1.5 $h^{-1}$ to 10 $h^{-1}$, or 2 $h^{-1}$ to 5 $h^{-1}$. In some embodiments, LHSV is at least 5 $h^{-1}$, at least 11 $h^{-1}$, at least 15 $h^{-1}$, or at least 20 $h^{-1}$. A partial pressure of hydrogen in the contacting zone may range from 0.1 MPa to 8 MPa, 1 MPA to 7 MPa, 2 MPa to 6 MPa, or 3 MPa to 5 MPa. In some embodiments, a partial pressure of hydrogen may be at most 7 MPa, at most 6 MPa, at most 5 MPa, at most 4 MPa, at most 3 MPa, or at most 3.5 MPa.

In embodiments in which the hydrogen source is supplied as a gas (for example, hydrogen gas), a ratio (as determined at normal conditions of 20° C. temperature and 1.013 bar pressure also referred to as N $m^3/m^3$) of the gaseous hydrogen source to the hydrocarbon feed may range from 0.1 $Nm^3/m^3$ to 100,000 $Nm^3/m^3$, 0.5 $Nm^3/m^3$ to 10,000 $Nm^3/m^3$, 1 $Nm^3/m^2$ to 8,000 $Nm^3/m^3$, 2 $Nm^3/m^3$ to 5,000 $Nm^3/m^3$, 5 $Nm^3/m^3$ to 3,000 $Nm^3/m^3$, or 10 $Nm^3/m^3$ to 800 $Nm^3/m^3$ contacted with the catalyst(s). The hydrogen source, in some embodiments, is combined with carrier gas(es) and recirculated through the contacting zone. Carrier gas may be, for example, nitrogen, helium, and/or argon. The carrier gas may facilitate flow of the hydrocarbon feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

The hydrogen source may enter contacting zone 102 cocurrently with the hydrocarbon feed via hydrocarbon feed conduit 104 or separately via gas conduit 106. In contacting zone 102, contact of the hydrocarbon feed with a catalyst produces a total product that includes a crude product, and, in some embodiments, gas. In some embodiments, a carrier gas is combined with the hydrocarbon feed and/or the hydrogen source in conduit 106. The total product may exit contacting zone 102 and be transported to other processing zones, storage vessels, or combinations thereof via conduit 108.

In some embodiments, contact of a hydrocarbon feed using the catalysts described herein at temperatures of at least 200° C. and pressures of at least 3 MPa produces a crude product that has a viscosity of at most 100 cSt at 37.8° C., a Ni/Fe/V content of between 100 wtppm and 300 wtppm; at least 0.01 grams of residue per gram of crude product; at least 0.02 grams of hydrocarbons having a boiling range distribution between 204° C. and 343° C. at 0.101 MPa per gram of crude product; at least 0.03 grams of hydrocarbons of a vacuum gas oil ("VGO") portion having a boiling range distribution between 343° C. and 538° C. at 0.101 MPA per gram of crude product, wherein the VGO fraction comprises at least 0.2 grams of total UV aromatics per gram of crude product.

In some embodiments, the total product may contain processing gas and/or gas formed during processing. Such gases may include, for example, hydrogen sulfide, carbon dioxide, carbon monoxide, excess gaseous hydrogen source, and/or a carrier gas. If necessary, the excess gas may be separated from the total product and recycled to contacting system 100, purified, transported to other processing zones, storage vessels, or combinations thereof. In some embodiments, gas produced during the process is at most 10 vol % based on total product, at most 5 vol % based on total product, or at most 1 vol % based the total product produced. In some embodiments, minimal or non-detectable amounts of gas are produced during contact of the feed with the catalyst. In such cases, the total product is considered the crude product.

In some embodiments, the disadvantaged crude (either topped or untopped) is separated prior to contact with one or more catalysts in contacting zone 102. During the separation process, at least a portion of the disadvantaged crude is separated using techniques known in the art (for example, sparging, membrane separation, pressure reduction) to produce the hydrocarbon feed. For example, water may be at least partially separated from the disadvantaged crude. In another example, components that have a boiling range distribution below 95° C. or below 100° C. may be at least partially separated from the disadvantaged crude to produce the hydrocarbon feed. In some embodiments, at least a portion of naphtha and compounds more volatile than naphtha are separated from the disadvantaged crude. In some embodiments, the crude product is blended with a crude that is the same as or different from the hydrocarbon feed. For example, the crude product may be combined with a crude having a different viscosity thereby resulting in a blended product having a viscosity that is between the viscosity of the crude product and the viscosity of the crude. In another example, the crude product may be blended with crude having a TAN, viscosity and/or API gravity that is different, thereby producing a product that has a selected property that is between that selected property of the crude product and the crude. The blended product may be suitable for transportation and/or treatment. In some embodiments, disadvantaged crude is separated to form the hydrocarbon feed. The hydrocarbon feed is then contacted with one or more catalysts to change a selected property of the hydrocarbon feed to form a total product. At least a portion of the total product and/or at least a portion of a crude product from the total product may blended with at least a portion of the disadvantaged crude and/or a different crude to obtain a product having the desired properties.

In some embodiments, the crude product and/or the blended product are transported to a refinery and distilled and/or fractionally distilled to produce one or more distillate fractions. The distillate fractions may be processed to produce commercial products such as transportation fuel, lubricants, or chemicals. Blending and separating of the disadvantaged crude and/or hydrocarbon feed, total product and/or crude product is described U.S. Published Patent Application No. 20050133414 to Bhan et al.

The method according to the invention may produce a crude product having changed properties (for example, MCR content, viscosity, residue $C_5/C_7$ asphaltenes, or combinations thereof) of at most 50%, at most 30%, at most 20%, at most 10%, at most 1% of the respective property of the hydrocarbon feed. The crude product has a VGO fraction that has a total UV aromatic content that may be equal to or greater than the total UV aromatic content of the VGO fraction of the hydrocarbon feed. Such a change in aromatic content may assist in maintaining the P-value above 1.0 at the lower pressures and controlled temperatures.

Further in some embodiments, the crude product may be a liquid mixture at 25° C. and 0.101 MPa.

In certain embodiments, the crude product has at least 100 wtppm, at least 150 wtppm, at least 200 wtppm or at least 220 wtppm of Ni/V/Fe. In some embodiments, a total Ni/V/Fe content of the crude product is 70% to 130%, 80% to 120%, or 90% to 110% of the Ni/V/Fe content of the hydrocarbon feed. In certain embodiments, the crude product has a total Ni/V/Fe content in a range from 0.1 to 5000 wtppm, from 1 to 1000 wtppm, from 10 to 500 wtppm, or from 100 to 350 wtppm.

In some embodiments, the crude product has a total molybdenum content of at most 90%, at most 50%, at most 10%, at most 5%, or at most 3% of the molybdenum content of the hydrocarbon feed. In certain embodiments, the crude product has a total molybdenum content ranging from 0.001 wtppm to 1 wtppm, from 0.005 wtppm to 0.1 wtppm, or from 0.01 to 0.05 wtppm.

In some embodiments, the crude product has a total content of metals in metal salts of organic acids of at most 90%, at most 50%, at most 10%, or at most 5% of the total content of metals in metal salts of organic acids in the hydrocarbon feed. Organic acids that generally form metal salts include, but are not limited to, carboxylic acids, thiols, imides, sulfonic acids, and sulfonates. Examples of carboxylic acids include, but are not limited to, naphthenic acids, phenanthrenic acids, and benzoic acid. The metal portion of the metal salts may include alkali metals (for example, lithium, sodium, and potassium), alkaline-earth metals (for example, magnesium, calcium, and barium), Column 12 metals (for example, zinc and cadmium), Column 15 metals (for example arsenic), Column 6 metals (for example, chromium), or mixtures thereof. In certain embodiments, the crude product has a total content of metals in metal salts of organic acids, per gram of crude product, in a range from 0.1 wtppm to 50 wtppm, 3 wtppm to 20 wtppm, or 10 wtppm to 1 wtppm of total metals in metal salt of organic acids per gram of crude product.

In certain embodiments, API gravity of the crude product produced from contact of the hydrocarbon feed with catalyst, at the contacting conditions, is increased by at least 2, at least 3, at least 5, or at least 10 relative to the API gravity of the hydrocarbon feed. In certain embodiments, API gravity of the crude product ranges from 10 to 40, 11 to 30, 13 to 25, or 14 to 20.

In certain embodiments, the crude product has a viscosity of at most 90%, at most 80%, or at most 70% of the viscosity of the hydrocarbon feed. In some embodiments, the viscosity of the crude product is at most 100, at most 500, or at most 100 cSt.

In some embodiments, the sulfur content of the crude product is at most 90%, at most 80% or at most 70% of the sulfur content of the hydrocarbon feed. In some embodiments the sulfur content of the crude product is at least 0.02 grams per gram of crude product. The sulfur content of the crude product may range from 0.001 grams to 0.1 grams, from 0.005 to 0.08 grams or from 0.01 to 0.05 grams per gram of crude product.

In some embodiments, the nitrogen content of the crude product is 70% to 130%, 80% to 120%, or 90% to 110% of the nitrogen content of the hydrocarbon feed. In some embodiments the nitrogen content of the crude product is at least 0.02 grams per gram of crude product. The nitrogen content of the crude product may range from 0.001 grams to 0.1 grams, from 0.005 to 0.08 grams or from 0.01 to 0.05 grams per gram of crude product.

In some embodiments, the crude product includes, in its molecular structures, from 0.05 grams to 0.15 grams or from 0.09 grams to 0.13 grams of hydrogen per gram of crude product. The crude product may include, in its molecular structure, from 0.8 grams to 0.9 grams or from 0.82 grams to 0.88 grams of carbon per gram of crude product. A ratio of atomic hydrogen to atomic carbon (H/C) of the crude product may be within 70% to 130%, within 80% to 120%, or within 90% to 110% of the atomic H/C ratio of the hydrocarbon feed. A crude product atomic H/C ratio within 10% to 30% of the hydrocarbon feed atomic H/C ratio indicates that uptake and/or consumption of hydrogen in the process is relatively small, and/or that hydrogen is produced in situ.

The crude product includes components with a range of boiling points. In some embodiments, the crude product includes, per gram of the crude product: at least 0.001 grams, or from 0.001 grams to 0.5 grams of hydrocarbons with a boiling range distribution of at most 100° C. at 0.101 MPa; at least 0.001 grams, or from 0.001 grams to 0.5 grams of hydrocarbons with a boiling range distribution between 100° C. and 200° C. at 0.101 MPa; at least 0.001 grams, or from 0.001 grams to 0.5 grams of hydrocarbons with a boiling range distribution between 200° C. and 300° C. at 0.101 MPa; at least 0.001 grams, or from 0.001 grams to 0.5 grams of hydrocarbons with a boiling range distribution between 300° C. and 400° C. at 0.101 MPa; and at least 0.001 grams, or from 0.001 grams 0.5 grams of hydrocarbons with a boiling range distribution between 400° C. and 538° C. at 0.101 MPa.

In some embodiments the crude product includes, per gram of crude product, at least 0.001 grams of hydrocarbons with a boiling range distribution of at most 100° C. at 0.101 MPa and/or at least 0.001 grams of hydrocarbons with a boiling range distribution between 100° C. and 200° C. at 0.101 MPa.

In some embodiments, the crude product has a total $C_5$ and $C_7$ asphaltenes content of at most 90%, at most 80%, at most 75%, or at most 50% of the total $C_5$ and $C_7$ asphaltenes content of the hydrocarbon feed. In other embodiments, the $C_5$ asphaltenes content of the crude product is at least 10%, at least 30%, or at least 40% of the $C_5$ asphaltenes content of the hydrocarbon feed. In certain embodiments, the crude product has, per gram of crude product, a total $C_5$ and $C_7$ asphaltenes content ranging from 0.001 grams to 0.2 grams, 0.01 to 0.15 grams, or 0.05 grams to 0.15 grams.

In certain embodiments, the crude product has a MCR content of at most 95%, at most 90%, or at most 80% of the MCR content of the hydrocarbon feed. In some embodiments, decreasing the $C_5$ asphaltenes content of the hydrocarbon feed while maintaining a relatively stable MCR content may increase the stability of the hydrocarbon feed/total product mixture.

The crude product has, in some embodiments, from 0.0001 grams to 0.20 grams, 0.005 grams to 0.15 grams, or 0.01 grams to 0.010 grams of MCR per gram of crude product.

In some embodiments, the crude product includes from greater than 0 grams, but less than 0.01 grams, 0.000001 grams to 0.001 grams, or 0.00001 grams to 0.0001 grams of total catalyst per gram of crude product. The catalyst present in the crude product may assist in stabilizing the crude product during transportation and/or treatment. The catalyst in the crude product may inhibit corrosion, inhibit friction, and/or increase water separation abilities of the crude product. Methods described herein may be configured to add one or more catalysts described herein to the crude product during treatment.

The crude product produced from contacting system 100 has properties different than properties of the hydrocarbon feed. Such properties may include, but are not limited to: a) reduced viscosity; b) reduced residue content; c) reduced content of $C_5$ and $C_7$ asphaltenes; d) reduced MCR content; e) increased API gravity; f) a reduced content of metals in metal salts of organic acids; g) reduced molybdenum content; or h) combinations thereof.

One or more properties of the crude product, relative to the hydrocarbon feed, may be selectively changed while other properties are not changed as much, or do not substantially change. For example, it may be desirable to only selectively reduce one or more components (for example, MCR content) in a hydrocarbon feed without significantly changing the amount of Ni/V/Fe in the hydrocarbon feed. In this manner, hydrogen uptake during contacting may be "concentrated" on MCR content reduction, and not reduction of other components. Since less of such hydrogen is also being used to reduce other components in the hydrocarbon feed, the amount of hydrogen used during the process may be minimized. For example, a disadvantaged crude may have a high MCR content, but a Ni/V/Fe content that is acceptable to meet treatment and/or transportation specifications. Such hydrocarbon feed may be more efficiently treated by reducing micro-carbon residue without also reducing Ni/V/Fe.

In some embodiments the crude product is separated into two or more portions. The crude product may for example be separated (for example by using membrane separation, or distillation techniques such as atmospheric distillation or fractional distillation) into two, three, four, five, six, seven, eight or more portions. In one embodiment the crude product is separated into three portions. In such case the crude product may be separated into a first portion, boiling below 343° C.

(650° F.) at 0.101 MPa, a second portion boiling in the range from 343° C. to 538° C. (650 to 100° F.) at 0.101 MPa and a third portion boiling above 538° C. (1000° F.) at 0.101 MPa. The first portion is herein below also referred to as Light Hydrocarbon Fraction, the second portion is herein below also referred to as Vacuum Gas Oil or VGO fraction, and the third portion is herein below also referred to as Residue.

Figure 2:
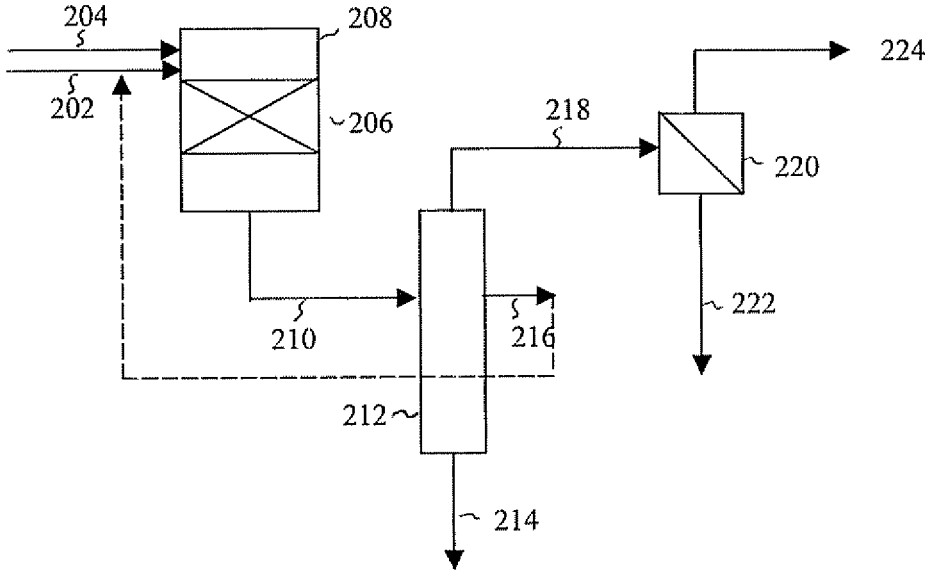
FIG. 2 is a schematic of an embodiment of an embodiment of a separation system.

FIG. 2 is a schematic of a process according to the invention.

The process comprises contacting a hydrocarbon feed, such as for example a crude feed (202) with a hydrogen source (204) and one or more catalysts (206) in a reactor (208) to produce a crude product (210). The crude feed may comprise at least 0.01 wt % of a vacuum gas oil fraction having a boiling range distribution between 343° C. and 538° C. at 0.101 MPA. The catalyst or catalysts may comprise at least one catalyst containing one or more metals from Column 6 of the Periodic Table and/or one or more compounds of one or more metals from Columns 6 of the Periodic Table.

The hydrocarbon feed (202) and hydrogen source (204) may be contacted at a partial pressure of hydrogen of least 3 MPa and a temperature of least 200° C.

The produced crude product (210) may be fractionated into three distillate fractions in a distillation tower or flasher (212). A first fractionated portion (214) may comprise residue. A second fractionated portion (216) may comprise vacuum gas oil, and a third fractionated portion (218) may contain lighter distillates. The fractionated portions, and especially the second (vacuum gas oil) fraction (216) may be used as a diluent to dilute for example a crude or another hydrocarbon composition, such as a short or long residue. In a further embodiment of a continuous process (shown by broken line) the vacuum gas oil may be recycled and combined with the crude feed (202) to the process. Such may be especially advantageous to maintain the stability of the crude feed/crude product mixture in the reactor (208). The stability and P-value of the crude feed/product mixture in reactor (208) may be improved by such recycle.

The third fractionated portion (218) may be separated into a liquid and a gas in a gas-liquid separator (220), whereafter a liquid fraction (222) and a gas fraction (224) may be obtained. The liquid fraction (222) is again especially useful as a diluent.

One or more fractions obtained in a fractionation of the crude product may be used to produce a transportation fuel. In some embodiments, the Vacuum Gas Oil that may be obtained in the fractionation is used wholly or in part to produce a transportation fuel. Such a transportation fuel may have an advantageously high total UV aromatics content.

Further, as also indicated above, one or more fractions obtained in a fractionation may be used to produce a diluent. In some embodiments, a Vacuum Gas Oil fraction that may be obtained in the fractionation is used wholly or in part to produce a diluent. Such a diluent may have an advantageously high total UV aromatics content. In a further embodiment the vacuum gas oil fraction obtained in the fractionation is used to dilute a crude feed. The later is especially advantageous as the high total UV aromatics content of the gas oil fraction may help to maintain the stability of the crude feed/crude product mixture.

In some embodiments, fractions boiling between 260° C. and 594° C. (500° F. and 1100° F.), 287° C. and 538° C. (550° F. and 1000° F.) 315° C. and 482° C. (600° F. and 900° F.) are obtained. Such fractions may be used in a diluent or as a diluent by itself. Such diluent may have a high total UV aromatics content.

In some embodiments, the crude product has a distillate content of at least 110%, at least 120%, or at least 130% of the Distillate content of the hydrocarbon feed. Such Distillate, boiling between 182° C. and 343° C. (360° F. and 650° F.) at 0.101 MPa, may be contained in a Light Hydrocarbon Fraction. The Distillate content of the crude product may be, per gram of crude product, in a range from 0.00001 grams to 0.6 grams (0.001-60 wt %), 0.001 grams to 0.5 grams (0.1-50 wt %), or 0.01 grams to 0.4 grams (1-40 wt %).

In some embodiments, the Distillate of the crude product includes UV aromatics. The Distillate, boiling between 182° C. and 343° C. (360° F. and 650° F.) at 0.101 MPa or respectively Light Hydrocarbon Fraction (boiling below 343° C. or 650° F. at 0.101 MPa) of the crude product may further include a similar or a higher amount of total UV aromatics as the Distillate or respectively Light Hydrocarbon Fraction of the crude feed. The UV aromatics may include, but are not limited to, mono, di, tri and/or tetra aromatics or mixtures thereof. The total UV aromatics content in the Distillate or respectively Light Hydrocarbon Fraction may range from 0.001 grams to 0.9 grams (0.1-90 wt %), from 0.01 grams to 0.5 grams (1-50 wt %), from 0.05 grams to 0.4 grams (5-40 wt %), from 0.1 grams to 0.3 grams (10-30 wt %), or from 0.1 grams to 0.2 grams (10-20 wt %) of total UV aromatics per gram of Distillate or respectively Light Hydrocarbon Fraction.

In some embodiments, the fractionated Light Hydrocarbon Fraction (boiling below 343° C. or 650° F.) includes at least 0.001 grams (0.1 wt %) of mono-aromatics per gram of Light Hydrocarbon Fraction. A total content of mono-aromatics in the Light Hydrocarbon Fraction may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.05 grams to 0.15 grams (5-15 wt %) of mono aromatics per gram of Light Hydrocarbon Fraction.

In some embodiments, the UV aromatic content in the Light Hydrocarbon Fraction of the crude product comprises mono aromatics, and the mono aromatic content of the Light Hydrocarbon Fraction is at least 110% of the mono aromatic content of the Light Hydrocarbon Fraction of the of the crude feed.

In some embodiments, the fractionated Light Hydrocarbon Fraction includes at least 0.001 grams (0.1 wt %) of di-aromatics per gram of Light Hydrocarbon Fraction. A total content of di-aromatics in the Light Hydrocarbon Fraction may range from 0.001 grams to 0.9 grams (0.1-90 wt %), from 0.005 grams to 0.5 grams (0.5-50 wt %), from 0.01 grams to 0.2 grams (1-20 wt %), from 0.02 grams to 0.1 grams (2-10 wt %), or from 0.02 grams to 0.1 grams (2-10 wt %) of di aromatics per gram of Light Hydrocarbon Fraction.

In some embodiments the total UV aromatic content in the Light Hydrocarbon Fraction of the crude product includes di-aromatics, and the di-aromatic content of the Light Hydrocarbon Fraction is at most 90% of the di-aromatic content of the Light Hydrocarbon Fraction of the crude feed.

In some embodiments the fractionated Light Hydrocarbon Fraction comprises at least 0.001 grams (0.1 wt %) of tri-aromatics per gram of Light Hydrocarbon Fraction. A total content of tri-aromatics in the Light Hydrocarbon Fraction may range from 0.001 grams to 0.9 grams (0.1-90 wt %), from 0.002 grams to 0.5 grams (0.2-50 wt %), from 0.005 grams to 0.1 grams (0.5-10 wt %), from 0.01 grams to 0.03 grams (1-3 wt %) of tri aromatics per gram of Light Hydrocarbon Fraction.

In some embodiments the total UV aromatic content in the Light Hydrocarbon Fraction of the crude product includes tri-aromatics, and the tri-aromatic content of the Light Hydrocarbon Fraction is at most 90% of the tri-aromatic content of the Light Hydrocarbon Fraction of the crude feed.

In some embodiments the fractionated Light Hydrocarbon Fraction includes at least 0.001 grams (0.1 wt %) of tetra-aromatics per gram of Light Hydrocarbon Fraction. A total content of tri-aromatics in the Light Hydrocarbon Fraction may range from 0.001 grams to 0.9 grams (0.1-90 wt %), from 0.002 grams to 0.5 grams (0.2-50 wt %), from 0.005 grams to 0.1 grams (0.5-10 wt %), from 0.01 grams to 0.03 grams (1-3 wt %) of tri aromatics per gram of Light Hydrocarbon Fraction.

In certain embodiments, the crude product has a VGO content, boiling between 343° C. to 538° C. at 0.101 MPa, of 70% to 130%, 80% to 120%, or 90% to 110% of the VGO content of the hydrocarbon feed. In some embodiments, the crude product has, per gram of crude product, a VGO content in a range from 0.00001 grams to 0.8 grams, 0.001 grams to 0.7 grams, 0.01 grams to 0.6 grams, or 0.1 grams to 0.5 grams.

In some embodiments, the VGO fraction of the crude product includes UV aromatics. The VGO fraction of the crude product may further include the same or a higher amount of UV aromatics as the Vacuum gas oil fraction of the crude feed. The UV aromatics may include, but are not limited to, mono, di, tri and/or tetra aromatics or mixtures thereof. A total content of UV aromatics in the VGO fraction may range from 0.001 grams to 0.9 grams (0.1-90 wt %), from 0.01 grams to 0.6 grams (1-60 wt %), from 0.05 grams to 0.5 grams (5-50 wt %), from 0.1 grams to 0.4 grams (10-40 wt %), or from 0.2 grams to 0.3 grams (20-30 wt %) of UV aromatics per gram of VGO fraction.

In some embodiments, the total UV aromatic content in the VGO fraction is at least 101%, at least 105%, at least 110%, at most 150%, at most 140% or at most 125% of the total UV aromatic content of the VGO fraction of the hydrocarbon feed.

In some embodiments the fractionated VGO fraction includes at least 0.001 grams (0.1 wt %) of mono-aromatics per gram of VGO fraction. A total content of mono-aromatics in the VGO fraction may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.05 grams to 0.1 grams (5-10 wt %) of mono aromatics per gram of VGO fraction.

In some embodiments, the total UV aromatic content in the VGO fraction of the crude product comprises mono aromatics, and the mono aromatic content of the VGO fraction is at most 90% of the mono aromatic content of the vacuum gas oil fraction of the of the crude feed.

In some embodiments the fractionated VGO fraction includes at least 0.001 grams (0.1 wt %) of di-aromatics per gram of VGO fraction. A total content of di-aromatics in the VGO fraction may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.05 grams to 0.1 grams (5-10 wt %) of di aromatics per gram of VGO fraction.

In some embodiments the fractionated VGO fraction includes at least 0.001 grams (0.1 wt %) of tri-aromatics per gram of VGO fraction. A total content of tri-aromatics in the VGO fraction may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.05 grams to 0.1 grams (5-10 wt %) of tri aromatics per gram of VGO fraction.

In some embodiments the total UV aromatic content in the VGO fraction of the crude product includes tri-aromatics, and the tri-aromatic content of the VGO fraction is at least 110% of the tri-aromatic content of the vacuum gas oil fraction of the of the crude feed.

In some embodiments the fractionated VGO fraction includes at least 0.001 grams (0.1 wt %) of tetra-aromatics per gram of VGO fraction. A total content of tetra-aromatics in the VGO fraction may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.03 grams to 0.1 grams (3-10 wt %) of tetra aromatics per gram of VGO fraction.

In some embodiments the total UV aromatic content in the VGO fraction of the crude product comprises tetra-aromatics, and the tetra-aromatic content of the VGO fraction is at least 110% of the tetra-aromatic content of the vacuum gas oil fraction of the of the crude feed.

In some embodiments, the crude product has a residue content of at most 90%, at most 80%, or at most 50% of the residue content of the hydrocarbon feed. The crude product may have, per gram of crude product, a residue content in a range from in a range from 0.00001 grams to 0.8 grams, 0.001 grams to 0.7 grams, 0.01 grams to 0.6 grams, 0.05 grams to 0.5 grams, or 0.1 to 0.3 grams.

In some embodiments, the residue portion of the crude product includes UV aromatics. The UV aromatics may include, but are not limited to, mono, di, tri and/or tetra aromatics. A total content of UV aromatics in the residue portion may range from 0.001 grams to 0.9 grams, from 0.01 grams to 0.6 grams or from 0.1 grams to 0.5 grams of UV aromatics per gram of Residue.

In some embodiments, the fractionated Residue comprises at least 0.001 grams (0.1 wt %) of mono-aromatics per gram of Residue. A total content of mono-aromatics in the Residue may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.03 grams to 0.1 grams (3-10 wt %) of mono aromatics per gram of Residue.

In some embodiments, the fractionated Residue comprises at least 0.001 grams (0.1 wt %) of di-aromatics per gram of Residue. A total content of di-aromatics in the Residue may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.03 grams to 0.1 grams (3-10 wt %) of di aromatics per gram of Residue.

In some embodiments, the fractionated Residue comprises at least 0.001 grams (0.1 wt %) of tri-aromatics per gram of Residue. A total content of tri-aromatics in the Residue may range from 0.001 grams to 0.9 grams (0.1-90 wt %), from 0.005 grams to 0.5 grams (0.5-50 wt %), from 0.01 grams to 0.3 grams (1-30 wt %), from 0.02 grams to 0.2 grams (2-20 wt %), or from 0.05 grams to 0.1 grams (5-10 wt %) of tri aromatics per gram of Residue.

In some embodiments, the fractionated Residue comprises at least 0.001 grams (0.1 wt %) of tetra-aromatics per gram of Residue. A total content of tetra-aromatics in the Residue may range from 0.001 grams to 0.9 grams (0.1-90 wt %), from 0.005 grams to 0.5 grams (0.5-50 wt %), from 0.01 grams to 0.4 grams (1-40 wt %), from 0.05 grams to 0.3 grams (5-30 wt %), or from 0.1 grams to 0.2 grams (10-20 wt %) of tetra aromatics per gram of Residue.

Catalysts used in one or more embodiments of the inventions may include one or more bulk metals and/or one or more metals on a support. The metals may be in elemental form or in the form of a compound of the metal. The catalysts described herein may be introduced into the contacting zone as a precursor, and then become active as a catalyst in the contacting zone (for example, when sulfur and/or a hydrocarbon feed containing sulfur is contacted with the precursor).

At least one of the catalysts used in the current invention comprises one or more metals from Column 6 of the Periodic Table and/or one or more compounds of one or more metals from Columns 6 of the Periodic Table. Columns 6 metal(s) include chromium, molybdenum and tungsten. The catalyst may have, per gram of catalyst, a total Column 6 metal(s) content of at least 0.00001, at least 0.01 grams, at least 0.02 grams and/or in a range from 0.0001 grams to 0.6 grams, 0.001 grams to 0.3 grams, 0.005 grams to 0.2 grams, 0.01 grams to 0.1 grams, or 0.01 grams to 0.08 grams. In some embodiments, the catalyst includes from 0.0001 grams to 0.06 grams of Column 6 metal(s) per gram of catalyst. In some embodiments, compounds of Column 6 metal(s) include oxides. For example, the Column 6 metal oxides are molybdenum trioxide and/or tungsten trioxide. In certain embodiments, the catalyst includes substantially Column 6 metals or only Column 6 metals. In an embodiment, the catalyst includes only molybdenum and/or molybdenum oxides. In some embodiments, the catalyst includes Column 15 element(s) in addition to the Column 6 metal(s). Examples of Column 15 elements include phosphorus. The catalyst may have a total Column 15 element content, per gram of catalyst, in range from 0.000001 grams to 0.1 grams, 0.00001 grams to 0.06 grams, 0.00005 grams to 0.03 grams, or 0.0001 grams to 0.001 grams.

In some embodiments, the catalyst includes a combination of Column 6 metal(s) with one or more metals from Columns 7-10. Columns 7-10 metal(s) include, but are not limited to, manganese, technetium, rhenium, iron, cobalt, nickel, ruthenium, palladium, rhodium, osmium, iridium, platinum, or mixtures thereof. The catalyst may have, per gram of catalyst, a total Columns 6-10 metal(s) content in a range from at least 0.0001 grams, at least 0.001 grams, at least 0.01 grams, or in a range of 0.0001 grams to 0.6 grams, 0.001 grams to 0.3 grams, 0.005 grams to 0.1 grams, or 0.01 grams to 0.08 grams. In some embodiments, the catalyst may include from 0.001 grams to 0.1 grams, 0.005 grams to 0.05 grams, or from 0.01 grams to 0.03 grams of Column 10 metal(s) per gram of catalyst. In certain embodiments, the catalyst may include from 0.001 grams to 0.1 grams, 0.005 to 0.05 grams, or from 0.01 grams to 0.03 grams of Column 9 metal(s) and/or Columns 10 metal(s) per gram of catalyst.

A molar ratio of Column 6 metal to Columns 7-10 metal may be in a range from 0.1 to 20, 1 to 10, or 2 to 5. In some embodiments, the catalyst includes Column 15 element(s) in addition to the combination of Column 6 metal(s) with one or more metals from Columns 7-10. Examples of Column 15 elements include phosphorus. The catalyst may have a total Column 15 element content, per gram of catalyst, in range from 0.000001 grams to 0.1 grams, 0.00001 grams to 0.06 grams, 0.00005 grams to 0.03 grams, or 0.0001 grams to 0.001 grams.

In other embodiments, the catalyst includes Column 6 metal(s) and Column 10 metal(s). A molar ratio of the total Column 10 metal to the total Column 6 metal in the catalyst may be in a range from 1 to 10, or from 2 to 5.

In some embodiments, the Column 6 metal and optionally any further metals are incorporated with a support to form the catalyst. In certain embodiments, Columns 6-10 metal(s) in combination with Column 15 element(s) are incorporated with a support to form the catalyst. In embodiments in which the metal(s) and/or element(s) are supported, the weight of the catalyst includes all support, all metal(s), and all element (s). The support may be porous and may include refractory oxides, porous carbon based materials, zeolites, or combinations thereof. Refractory oxides may include, but are not limited to, alumina, silica, silica-alumina, titanium oxide, zirconium oxide, magnesium oxide, or mixtures thereof. Supports may be obtained from a commercial manufacturer such as Criterion Catalysts and Technologies LP (Houston, Tex., U.S.A.). Porous carbon based materials include, but are not limited to, activated carbon and/or porous graphite. Examples of zeolites include Y-zeolites, beta zeolites, mordenite zeolites, ZSM-5 zeolites, and ferrierite zeolites. Zeolites may be obtained from a commercial manufacturer such as Zeolyst (Valley Forge, Pa., U.S.A.).

In certain embodiments, the support includes gamma alumina, delta alumina, alpha alumina, or combinations thereof. The amount of gamma alumina, delta alumina, alpha alumina, or combinations thereof, per gram of catalyst support, may be in a range from 0.0001 grams to 0.99 grams, 0.001 grams to 0.5 grams, 0.01 grams to 0.1 grams, or at most 0.1 grams as determined by x-ray diffraction.

The metal(s) and support may be mixed (for example, co-mulled) with suitable mixing equipment to form a metal (s)/support mixture. The metal(s)/support mixture may be mixed using suitable mixing equipment. Examples of suitable mixing equipment include tumblers, stationary shells or troughs, Muller mixers (for example, batch type or continuous type), impact mixers, and any other generally known mixer, or generally known device, that will suitably provide the metal(s)/support mixture. In certain embodiments, the materials are mixed until the metal(s) is (are) substantially homogeneously dispersed in the support. Dispersion of the metal(s) may inhibit coking of the metal(s) at high temperatures and/or pressures, thus allowing hydrocarbon feeds containing significant amounts of residue and/or high viscosities to be processed at rates, temperatures, and pressures not obtainable by using conventional catalysts made using impregnation techniques.

In some embodiments, an acid and/or water is added to the mixture to assist in formation of the mixture into particles. The water and/or dilute acid are added in such amounts and by such methods as required to give the mixture a desired consistency suitable to be formed into particles. Examples of acids include, but are not limited to, nitric acid, acetic acid, sulfuric acid, and hydrochloric acid.

The paste may be formed into particles using known techniques in the art such as an extruder. The particles (extrudates) may be cut using known catalyst cutting methods to form particles. The particles may be heat treated at a temperature in a range from 65° C. to 260° C. or from 85° C. to 235° C. for a period of time (for example, for 0.5 hours to 8 hours) and/or until the moisture content of the particle has reached a desired level.

The catalyst may be heat treated (calcined) in the presence of hot air and/or oxygen rich air at a temperature in a range between 400° C. and 1000° C., between 450° C. and 760° C., or between 500° C. and 680° C. for a period of time (for example 0.5 to 8 hours or 1 to 5 hours) to remove volatile matter such that at least a portion of the metals are converted to the corresponding metal oxide. The temperature conditions at which the particles are calcined may be such that the pore structure of the final calcined mixture is controlled to form the pore structure and surface areas of the catalysts described herein. Calcining at temperatures below 650° C. may change the distribution of pores and the surface area such that the catalyst is even more effective in removing compounds that contribute to high viscosity and/or residue.

In some embodiments, the support (either a commercial support or a support prepared as described herein) may be combined with a supported catalyst and/or a bulk metal catalyst. In some embodiments, the supported catalyst may include Column 15 metal(s). For example, the supported catalyst and/or the bulk metal catalyst may be crushed into a powder with an average particle size from 1 microns to 50 microns, 2 microns to 45 microns, or 5 microns to 40 microns. The powder may be combined with support as described herein to form an embedded metal catalyst. In some embodiments, the powder may be combined with the support and then extruded using standard techniques.

Combining the catalyst with the support (for example, co-mulling) allows, in some embodiments, at least a portion of the metal to reside under the surface of the embedded metal catalyst (for example, embedded in the support), leading to less metal on the surface than would otherwise occur in the unembedded metal catalyst. In some embodiments, having less metal on the surface of the catalyst extends the life and/or catalytic activity of the catalyst by allowing at least a portion of the metal to move to the surface of the catalyst during use. The metals may move to the surface of the catalyst through erosion of the surface of the catalyst during contact of the catalyst with a hydrocarbon feed.

In some embodiments, the catalyst is prepared by combining one or more metal(s), mineral oxides having a particle size of at most 500 micrometers, and a support. The mineral oxides may include alumina, silica, silica-alumina, titanium oxide, zirconium oxide, magnesium oxide, or mixtures thereof. The mineral oxides may be obtained from an extrudate process to produce support. For example, alumina fines can be obtained from an alumina extrudate production to produce catalyst supports. In some embodiments, mineral oxide fines may have a particle size of at most 500 micrometers, at most 150 micrometers, at most 100 micrometers, or at most 75 micrometers. The particle size of the mineral oxides may range from 0.2 micrometers to 500 micrometers, 0.3 micrometers to 100 micrometers, or 0.5 micrometers to 75 micrometers. Combining mineral oxides with one or more metal(s) and a support may allow less metal to reside on the surface of the catalyst.

In some embodiments, the catalyst may be prepared by combining a supported catalyst with a support and one or more metal(s) to produce the catalyst. In some embodiments, the metal(s) (for example, molybdenum oxides and/or tungsten oxides) have a particle size of at most 500 micrometers, at most 150 micrometers, at most 100 micrometers, or at most 75 micrometers. The particle size of the metal(s) may range from 0.1 micrometers to 500 micrometers, 1 micrometers to 100 micrometers, or 10 micrometers to 75 micrometers. In some embodiments, at least 50 percent of the particles have a particle size between 2 micrometers to 15 micrometers. The mixture of the supported catalyst with a support and one or more metal(s) is dried at temperatures of at least 100° C. to remove any low boiling components and then heated to at least 500° C., at least 1000° C., at least 1200° C., or at least 1300° C. to convert at least a portion of the Columns 6-10 metal(s) to metal oxides.

Hence, in some embodiments the catalyst of the application may be prepared by combining a support with one or more Columns 6 metal(s) and optionally one or more 7-10 metal(s), mineral oxides having a particle size of at most 500 micrometer, and/or a supported catalyst.

Without wishing to be bound by any kind of theory, intercalation and/or mixing (for example, co-mulling) of the components of the catalysts changes, in some embodiments, the structured order of the Column 6 metal in the Column 6 oxide crystal structure to a substantially random order of Column 6 metal in the crystal structure of the embedded catalyst. The order of the Column 6 metal may be determined using powder x-ray diffraction methods. The order of elemental metal in the catalyst relative to the order of elemental metal in the metal oxide may be determined by comparing the order of the Column 6 metal peak in an x-ray diffraction spectrum of the Column 6 oxide to the order of the Column 6 metal peak in an x-ray diffraction spectrum of the catalyst. From broadening and/or absence of patterns associated with Column 6 metal in an x-ray diffraction spectrum, it is possible to estimate that the Column 6 metal(s) are substantially randomly ordered in the crystal structure.

For example, molybdenum trioxide and the alumina support having a median pore diameter of at least 180 Å may be combined to form an alumina/molybdenum trioxide mixture. The molybdenum trioxide has a definite pattern (for example, definite $D_{001}$, $D_{002}$ and/or $D_{003}$ peaks). The alumina/molybdenum trioxide mixture may be heat treated at a temperature of at least 538° C. (1000° F.) to produce a catalyst that does not exhibit a pattern for molybdenum trioxide in an x-ray diffraction spectrum (for example, an absence of the $D_{001}$ peak).

The catalyst prepared with supported catalyst fines and/or mineral oxide fines when analyzed using scanning electron microscopy, may exhibit a significantly lower degree of molybdenum disulfide ($MoS_2$) slab stacking with the stacks having reduced heights and length as compared to alternative molybdenum-containing hydroprocessing catalysts.

In some embodiments, catalysts may be characterized by pore structure. Various pore structure parameters include, but are not limited to, pore diameter, pore volume, surface areas, or combinations thereof. The catalyst may have a distribution of total quantity of pore sizes versus pore diameters. The catalyst may have a pore size distribution with a median pore diameter of at least 60 Å, at least 90 Å, or at most 200 Å. In some embodiments, the catalyst has a pore size distribution with a median pore diameter in a range from 70 Å to 200 Å, 90 Å to 150 Å, or 100 Å to 120 Å, in further embodiment at least 60% of a total number of pores in the pore size distribution has a pore diameter within 45 Å, 35 Å, or 25 Å of the median pore diameter.

In some embodiments, pore volume of pores may be at least 0.3 $cm^3/g$, at least 0.7 $cm^3/g$, or at least 0.9 $cm^3/g$. In certain embodiments, pore volume of pores may range from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

The pore volume of the catalyst may include pores having a pore diameter between 1 Å and 5000 Å and pores having a pore diameter greater than 5000 Å. In some embodiments, the catalyst has a majority of its pore volume in pores having a pore diameter of at most 300 Å, at most 200 Å, or at most 100 Å. The catalyst may have at most 95% of its pore volume in pores having a pore diameter of at most 300 Å, at most 200 Å, or at most 100 Å, with the balance of the pore volume being in pores having a pore diameter of at least 300 Å.

In some embodiments, the catalyst has at most 80% of its pore volume in pores having a pore diameter of at most 200 Å, with the balance of the pore volume being in pores having a pore diameter of at least 300 Å.

In other embodiments, the catalyst has two distinct pore distributions (for example, a bimodal pore distribution with a pore size distribution comprising two peaks). The catalyst may have a portion of its pore volume in pores having a pore diameter of at most 500 Å, at most 300 Å, or at most 200 Å and a portion of its pore volume in pores having a pore diameter of at least 1000 Å, at least 3000 Å, or least 5000 Å. In some embodiments, the catalyst has at most 40%, or at most 30% of its pore volume in pores having a pore diameter of at least 5000 Å, from 10% to 60% of its pore volume in pores having a pore diameter from about 70 Å to about 130 Å, and the balance of the pore volume being in pores having a pore diameter between 130 Å and 5000 Å.

In some embodiments, the catalyst having a pore size distribution with a median pore diameter in a range from about 50 Å to 150 Å, may have a surface areas of at least 200 $m^2/g$. Such surface area may be in a range from 200 $m^2/g$ to 500 $m^2/g$, 210 $m^2/g$ to 450 $m^2/g$, or 225 $m^2/g$ to 425 $m^2/g$.

Catalysts having specific surface topology, large surface areas and pore distributions described above may exhibit enhanced run times in commercial applications at low pressures and elevated temperatures. For example, the catalyst may remain active after at least 1 year of run time. The enhanced run times may be attributed to the high surface area of the catalyst and/or the narrow distribution of pore diameter in the pore volume of the catalyst. Thus, the metals of the catalyst remain exposed for longer periods of time, thus plugging of the pores of the catalyst is minimal. The high surface area and selected distribution of pores in the pore volume of the catalyst allows processing of high viscosity and/or high residue crudes that would not be able to be processed with conventional catalysts having the same pore distribution, but smaller surface area.

In certain embodiments, the catalyst exists in shaped forms, for example, pellets, cylinders, and/or extrudates. In some embodiments, the catalyst and/or the catalyst precursor is sulfided to form metal sulfides (prior to use) using techniques known in the art (for example, ACTICAT™ process, CRI International, Inc.). In some embodiments, the catalyst may be dried then sulfided. Alternatively, the catalyst may be sulfided in situ by contact of the catalyst with a hydrocarbon feed that includes sulfur-containing compounds. In-situ sulfurization may utilize either gaseous hydrogen sulfide in the presence of hydrogen, or liquid-phase sulfurizing agents such as organosulfur compounds (including alkylsulfides, polysulfides, thiols, and sulfoxides). Ex-situ sulfurization processes are described in U.S. Pat. No. 5,468,372 to Seamans et al., and U.S. Pat. No. 5,688,736 to Seamans et al., all of which are incorporated herein by reference. Liquid sulfiding processes are described in U.S. Pat. No. 6,290,841 to Gabrielov et al. which liquid sulfiding processes are incorporated herein by reference.

The catalyst may reduce at least a portion of the components that contribute to higher viscosities, a portion of the components that contribute to residue MCR content and/or $C_5$ asphaltenes in the feed. The catalyst may change the aromatic content of the hydrocarbon feed/total product mixture such that at least a portion of the compounds that contribute to instability in the hydrocarbon feed/total product mixture are partially or, in some embodiments, substantially solubilized. The catalyst may have a surface area and pore structure which enhances the catalyst life as measured by length of run time without plugging and/or decrease in P-value as compared to conventional catalysts. The catalyst's structure may allow the properties of the crude to be changed at lower operating pressures and elevated temperatures as compared to conventional catalysts at the same operating conditions.

Using the catalyst and controlling operating conditions may allow a crude product to be produced that has selected properties changed relative to the hydrocarbon feed while other properties of the hydrocarbon feed are not significantly changed. The resulting crude product may have enhanced properties relative to the hydrocarbon feed and, thus, be more acceptable for transportation and/or refining.

Combinations of the catalyst of the application and other selected catalysts may allow reduction of at least a portion of the $C_5$ asphaltenes, at least a portion of the metals in metal salts of organic acids, at least a portion of the residue, MCR content, or combinations thereof, from the hydrocarbon feed before other properties of the hydrocarbon feed are changed, while maintaining the stability of the hydrocarbon feed/total product mixture during processing (for example, maintaining a hydrocarbon feed P-value of above 1.0). Alternatively, $C_5$ asphaltenes, and/or API gravity may be reduced by contact of the hydrocarbon feed with the selected catalysts. The ability to selectively change properties of the hydrocarbon feed may allow the stability of the hydrocarbon feed/total product mixture to be maintained during processing.

Arrangement and/or selection of the catalysts may, in some embodiments, improve the usable life of the catalysts and/or the stability of the hydrocarbon feed/total product mixture. Improvement of a catalyst life and/or stability of the hydrocarbon feed/total product mixture during processing may allow a contacting system to operate for at least 3 months, at least 6 months, or at least 1 year without replacement of the catalyst in the contacting zone.

The order and/or number of catalysts may be selected to minimize net hydrogen uptake while maintaining the hydrocarbon feed/total product stability. Minimal net hydrogen uptake allows residue content, VGO content, distillate content, API gravity, or combinations thereof of the hydrocarbon feed to be maintained within 20% of the respective properties of the hydrocarbon feed, while the API gravity and/or the viscosity of the crude product is at most 90% of the API gravity and/or the viscosity of the hydrocarbon feed.

Reduction in net hydrogen uptake by the hydrocarbon feed may produce a crude product that has a boiling range distribution similar to the boiling point distribution of the hydrocarbon feed. The atomic H/C ratio of the crude product may also only change by relatively small amounts as compared to the atomic H/C ratio of the hydrocarbon feed.

In some embodiments, catalyst selection and/or order of catalysts in combination with controlled contacting conditions (for example, temperature and/or hydrocarbon feed flow rate) may assist in reducing hydrogen uptake by the hydrocarbon feed, maintaining hydrocarbon feed/total product mixture stability during processing, and changing one or more properties of the crude product relative to the respective properties of the hydrocarbon feed. Stability of the hydrocarbon feed/total product mixture may be affected by various phases separating from the hydrocarbon feed/total product mixture. Phase separation may be caused by, for example, insolubility of the hydrocarbon feed and/or crude product in the hydrocarbon feed/total product mixture, flocculation of asphaltenes from the hydrocarbon feed/total product mixture, precipitation of components from the hydrocarbon feed/total product mixture, or combinations thereof.

At certain times during the contacting period, the concentration of hydrocarbon feed and/or total product in the hydrocarbon feed/total product mixture may change. As the concentration of the total product in the hydrocarbon feed/total product mixture changes due to formation of the crude product, solubility of the components of the hydrocarbon feed and/or components of the total product in the hydrocarbon feed/total product mixture tends to change. For example, the hydrocarbon feed may contain components that are soluble in the hydrocarbon feed at the beginning of processing. As properties of the hydrocarbon feed change (for example, API gravity, viscosity, MCR, $C_5$ asphaltenes, P-value, or combinations thereof), the components may tend to become less soluble in the hydrocarbon feed/total product mixture. In some instances, the hydrocarbon feed and the total product may form two phases and/or become insoluble in one another.

Solubility changes may also result in the hydrocarbon feed/total product mixture forming two or more phases. Formation of two phases, through flocculation of asphaltenes, change in concentration of hydrocarbon feed and total product, and/or precipitation of components, tends to reduce the life of one or more of the catalysts. Additionally, the efficiency of the process may be reduced. For example, repeated treatment of the hydrocarbon feed/total product mixture may be necessary to produce a crude product with desired properties.

During processing, the P-value of the hydrocarbon feed/total product mixture may be monitored and the stability of the process, hydrocarbon feed, and/or hydrocarbon feed/total product mixture may be assessed. Typically, a P-value that is at most 1.0 indicates that flocculation of asphaltenes from the hydrocarbon feed generally occurs. If the P-value is initially at least 1.0, and such P-value increases or is relatively stable during contacting, then this indicates that the hydrocarbon feed is relatively stabile during contacting. Hydrocarbon feed/total product mixture stability, as assessed by P-value, may be controlled by controlling contacting conditions, by selection of catalysts, by selective ordering of catalysts, or combinations thereof. Such controlling of contacting conditions may include controlling LHSV, temperature, pressure, hydrogen uptake, hydrocarbon feed flow, or combinations thereof.

The crude product produced by contacting a hydrocarbon feed with one or more catalysts described herein may be useful in a wide range of applications including, but not limited to, use a feed to refineries, feed for producing transportation fuel, a diluent, or an enhancing agent for underground oil recovery processes.

For example, hydrocarbon feeds having an API gravity of at most 10 (for example, bitumen and/or heavy oil/tar sands crude) may be converted into various hydrocarbon streams through a series of processing steps using cracking units (for example, an ebullating bed cracking unit, a fluid catalytic cracking unit, thermal cracking unit, or other units known to convert hydrocarbon feed to lighter components).

Reduction of the MCR content of a hydrocarbon feed to produce a feed stream that may be processed in cracking units may enhance the processing rate of hydrocarbon feed. A system using the methods and catalysts described herein to change properties of a hydrocarbon feed may be positioned upstream of one or more cracking units. Treatment of the hydrocarbon feed in one or more systems described herein may produce a feed that improves the processing rate of the cracking unit by at least a factor of 2, at least a factor of 4, at least a factor of 10, or at least a factor of 100. For example, a system for treating a hydrocarbon feed having a MCR content of at least 0.01 grams per gram of hydrocarbon feed at least 0.0001 grams of hydrocarbons of a VGO fraction per gram of hydrocarbon feed, wherein the VGO fraction comprises at least 0.05 grams of UV aromatics per gram of VGO fraction may include one or more contacting systems described herein positioned upstream of a cracking unit. The contacting system may include one or more catalysts described herein capable of producing a crude product having MCR content of at most 90% of the hydrocarbon feed MCR content and wherein a total UV aromatic content in a VGO fraction of the crude product is greater than or equal to the total UV aromatics content of the hydrocarbon feed VGO fraction. The crude product and/or a mixture of the crude product and hydrocarbon feed may enter a cracking unit. Since the crude product and/or mixture of the crude product and hydrocarbon feed have less components that contribute to coking (MCR content), than the original hydrocarbon feed, the processing rate through the cracking unit may be improved.

Hydrocarbon feeds having at least 0.01 grams of $C_5$ asphaltenes may be deasphalted prior to hydroprocessing treatment in a refinery operation. Deasphalting processes may involve solvent extraction and/or contacting the crude with a catalyst to remove asphaltenes. Reduction of at least a portion of the components that contribute to viscosity, at least a portion of the components that contribute to MCR, at least a portion of the components that contribute to residue and/or at least a portion of the components that contribute to asphaltenes prior to the deasphalting process may eliminate the need for solvent extraction, reduce the amount of required solvent, and/or enhance the efficiency of the deasphalting process. For example, a system for treating a hydrocarbon feed having, per gram of hydrocarbon feed, at least 0.01 grams of $C_5$ asphaltenes and/or 0.1 grams of residue and a viscosity of at least 10 cSt at 37.8° C. may include one or more contacting systems described herein positioned upstream of a deasphalting unit. The contacting system may include the catalyst described herein capable of producing a crude product having a MCR content of at most 90% of the hydrocarbon feed MCR content, a viscosity of at most 50% of the hydrocarbon viscosity, and a VGO fraction that has a total UV aromatic content of greater than or equal to of the total UV aromatic content of the hydrocarbon feed VGO fraction, or combinations thereof. The crude product and/or a mixture of the crude product and hydrocarbon feed may enter the deasphalting unit. Since the crude product and/or mixture of the crude product and the hydrocarbon feed has a lower asphaltene, residue and/or viscosity and a changed UV aromatic content in the VGO fraction than the original hydrocarbon feed, the processing efficiency of the deasphalting unit may be increased by at least 5%, at least 10%, at least 20% or at least 50% of the original efficiency.

EXAMPLES

Non-limiting examples of a catalyst preparation and methods of using such catalyst under controlled contacting conditions are set forth below.

Example 1

Preparation of Column 6 Metal(s) Catalyst Containing Mineral Oxide Fines

The catalyst was prepared in the following manner. $MoO_3$ (94.44 grams) was combined with alumina (2742.95 grams) and crushed and sieved alumina fines having a particle size between 5 and 10 micrometers (1050.91 grams) in a muller. With the muller running, nitric acid (43.04 grams, 69.7 M) and deionized water (4207.62 grams) were added to the mixture and the resulting mixture was mulled for 5 minutes. Superfloc® 16 (30 grams, Cytec Industries, West Paterson, N.J., USA) was added to the mixture in the muller, and the mixture was mulled for a total of 25 minutes. The resulting mixture had a pH of 6.0 and a loss on ignition of 0.6232 grams per gram of mixture. The mulled mixture was extruded using 1.3 mm trilobe dies to form 1.3 trilobe extrudate particles. The extrudate particles were dried at 125° C. for several hours and then calcined at 676° C. (1250° F.) for two hours to produce the catalyst. The catalyst contained, per gram of catalyst, 0.02 grams of molybdenum, with the balance being mineral oxide and support. The catalyst had a pore size distribution with a median pore diameter of 117 Å with 60% of the total number of pores in the pore size distribution having a pore diameter within 33 Å of the median pore diameter, a surface area of 249 $m^2/g$, and a total pore volume of 0.924 cc/g.

The pore size distribution measured using mercury porosimetry at a contact angle of 140 is shown in TABLE 1.

TABLE 1

| Pore Diameter in Å | % Pore Volume |
|---|---|
| <70 | 0.91 |
| 70-100 | 20.49 |
| 100-130 | 37.09 |
| 130-150 | 4.51 |
| 150-180 | 2.9 |
| 180-200 | 1.06 |
| 200-1000 | 0.85 |
| 1000-5000 | 5.79 |
| >5000 | 22.04 |

This example demonstrates a catalyst that includes a support, mineral oxides, and one or more metals from Column 6 of the Periodic Table and/or one or more compounds of one or more metals from Column 6 of the Periodic Table. The catalyst has a pore size distribution with a median pore diameter of at least 80 Å and the catalyst is obtainable by combining: mineral oxide fines; one or more metals from Column 6 of the Periodic Table and/or one or more compounds of one or more metals from Column 6 of the Periodic Table; and a support.

Example 2

Contact of a Hydrocarbon Feed with Example 1 Catalyst

A tubular reactor with a centrally positioned thermowell was equipped with thermocouples to measure temperatures throughout a catalyst bed. The catalyst bed was formed by filling the space between the thermowell and an inner wall of the reactor with catalysts and silicon carbide (20-grid, Stanford Materials; Aliso Viejo, Calif.). Such silicon carbide is believed to have low, if any, catalytic properties under the process conditions described herein. All catalysts were blended with an equal volume amount of silicon carbide before placing the mixture into the contacting zone portions of the reactor.

The crude feed flow to the reactor was from the top of the reactor to the bottom of the reactor. Silicon carbide was positioned at the bottom of the reactor to serve as a bottom support.

A volume of Column 6 metal catalyst (24 $cm^3$) prepared as described in Example 1 was mixed with silicone carbide (24 $cm^3$) and the mixture positioned in the bottom contacting zone.

A Column 6 metal catalyst (6 $cm^3$) prepared as described in Example 1 was mixed with silicone carbide (6 $cm^3$) and the mixture positioned on top of the contacting zone to form a top contacting zone.

Silicon carbide was positioned on top of the top contacting zone to fill dead space and to serve as a preheat zone. The catalyst bed was loaded into a Lindberg furnace that included four heating zones corresponding to the preheat zone, the top and bottom contacting zones, and the bottom support.

The catalysts were sulfided using the liquid sulfiding method as described in U.S. Pat. No. 6,290,841 to Gabrielov et al. which is incorporated herein by reference. After sulfidation of the catalysts, the temperature of the contacting zones was raised to a temperature of 418° C. A hydrocarbon feed (Peace River) having the properties listed in Table 2. The hydrocarbon feed flowed through the preheat zone, top contacting zone, bottom contacting zone, and bottom support of the reactor. The hydrocarbon feed was contacted with each of the catalysts in the presence of hydrogen gas. Contacting conditions were as follows: ratio of hydrogen gas to feed was 318 $Nm^3/m^3$ (2000 SCFB) and LHSV was about 0.5 $h^{-1}$. The two contacting zones were heated to 400° C. and maintained between 400° C. and 420° C. at a pressure of 3.5 MPa (500 psig) for 4200 hours as the hydrocarbon feed flowed through the reactor.

After its production the crude product was distilled into three fractions, a first fraction boiling below 650° F., a second fraction boiling between 650-1000° F. and a third fraction boiling above 1000° F. The results of analyzing the fractions are listed in Table 2.

As shown in Table 2, the crude product had a viscosity of 70 at 37.8° C., a residue content of 0.244 grams, per gram of crude product, a Ni/V/Fe content of 258.2 wtppm, a molybdenum content of 0.4 wtppm, and a MCR content of 0.099 grams per gram of crude product. The increase in the total amount of UV aromatics in the VGO fraction indicate that hydrogenation of the heavier asphaltenes is not occurring. The increase in aromatic compounds in the VGO may allow solubilization of the polar compounds in the mixture. The solubilization of polar compounds may enhance the life of the catalyst by preventing plugging of the catalyst pores.

This example demonstrates that contact of a hydrocarbon feed with one or more catalysts, where at least one of the catalyst includes one or more metals from Column 6 of the Periodic Table and/or one or more compounds of one or more metals from Columns 6 of the Periodic Table produces a crude product having a MCR content of at most 90% of MCR content of the hydrocarbon feed; and having total content of UV aromatics in a VGO fraction of the crude product which is greater than or equal to the total UV aromatics content of the hydrocarbon feed VGO fraction of the hydrocarbon feed.

This example also demonstrates the production of a crude product that has a viscosity of at most 100 cSt at 37.8° C., a Ni/Fe/V content of between 100 wtppm and 300 wtppm; at least 0.01 grams of residue per gram of crude product; at least 0.2 grams of hydrocarbons having a boiling range distribution between 204° C. and 343° C. at 0.101 MPa per gram of crude product; at least 0.3 grams of hydrocarbons of a vacuum gas oil ("VGO") portion having a boiling range distribution between 343° C. and 538° C. at 0.101 MPA per gram of crude product, where the VGO fraction comprises at least 0.2 grams of UV aromatics per gram of crude product.

Example 3

Blend

A blend of the VGO fraction of the crude product with hydrocarbon feed having a P-value of less was made in the following manner.

The crude product obtained in example 2 was distilled using the method described in ASTM Method D-1160 to obtain the VGO fraction. A sample of a hydrocarbon feed (processed Peace River hydrocarbon feed) having a P-value of less than 1.0 was obtained. 10 ml of the hydrocarbon feed sample was mixed with 3 ml of the VGO fraction.

The mixture was shaken and allowed to stand. The P-value of the mixture of the hydrocarbon feed sample and the VGO fraction was 1.2.

This example demonstrates that a separated portion of the crude product, such as the VGO fraction, may advantageously be used to increase the P-value of a hydrocarbon composition by diluting such hydrocarbon composition with it. Hence, a relatively unstable hydrocarbon composition may be stabilized by mixing it with a separated portion of the crude product, such as a VGO fraction, having a high total content of UV aromatics.

TABLE 2

| Example | Property: Feed 2 | Property: Crude Product 2 |
|---|---|---|
| Contact Time, hours | — | 3030 |
| Temperature, ° C. | — | 419 |
| Pressure, MPa | — | 3.5 |
| API Gravity | 7.9 | 14.6 |
| Density at 15.56° C. (60° F.), g/cm$^3$ | 1.0149 | 0.9682 |
| Hydrogen, wt % | 10.109 | 10.605 |
| Carbon, wt % | 81.987 | 84.380 |
| Sulfur, wt % | 6.687 | 4.443 |
| Oxygen, wt % | 0.62 | 0.572 |
| Nitrogen, wt % | 0.366 | 0.384 |
| Nickel, wtppm | 70 | 66 |
| Iron, wtppm | 2.4 | 0.2 |
| Vanadium, wtppm | 205 | 192 |
| Calcium, wtppm | 6.7 | 1.0 |
| Copper wtppm | 0.9 | 0.6 |
| Chromium, wtppm | 0.3 | 0.2 |
| Silicon, wtppm | 1.2 | 0.3 |
| Magnesium, wtppm | 0.8 | 0.9 |
| Zinc, wtppm | 6.0 | 2.0 |
| Sodium, wtppm | 6.9 | * |
| Potassium, wtppm | 1.2 | * |
| Molybdenum, wtppm | 6.6 | 0.4 |
| Micro-Carbon Residue, wt % | 12.5 | 9.9 |
| $C_5$ Asphaltenes, wt % | 16.2 | 7.7 |
| $C_7$ Asphaltenes, wt % | 10.9 | 5.8 |
| Distillate, wt % | 15.0 | 32.9 |
| VGO, wt % | 37.5 | 40.5 |
| Residue, wt % | 47.4 | 24.4 |
| P-Value | 2.6 | 1.2 |
| Viscosity at 37.8° C. (100° F.), cSt | 8357 | 70 |
| Hydrogen Consumption, Nm$^3$/m$^3$ | | 37.21 |
| Sediment, wt % | | 0.007 |
| Fraction with a boiling point below 343° C. | | |
| UV Aromatics, total, wt % of fractions | 17.68 | 17.27 |
| Mono, wt % of fraction | 7.45 | 9.21 |
| Di, wt % of fraction | 6.65 | 5.28 |
| Tri, wt % of fraction | 2.33 | 1.58 |
| Tetra, wt % of fraction | 1.25 | 1.2 |
| Hydrogen, wt % of fraction | | 11.91 |
| Carbon, wt % of fraction | | 85.43 |
| Sulfur, wt % of fraction | | 3.69 |

TABLE 2-continued

| Example | Property: Feed 2 | Property: Crude Product 2 |
|---|---|---|
| Nitrogen, wt % of fraction | | 0.0721 |
| VGO Fraction (boiling between 343° C. and 538° C.) | | |
| UV Aromatics total wt % of fraction | 11.77 | 24.35 |
| Mono, wt % of fraction | 6.45 | 5.89 |
| Di, wt % of fraction | 1.99 | 5.82 |
| Tri, wt % of fraction | 1.64 | 7.06 |
| Tetra, wt % of fraction | 1.69 | 5.58 |
| Hydrogen, wt % of fraction | | 10.78 |
| Carbon, wt % of fraction | | 85.49 |
| Sulfur, wt % of fraction | * | 4.6278 |
| Nitrogen, wt % of fraction | * | 0.2789 |
| Viscosity of fraction at 37.8° C. (100° F.), cSt | * | 91.7 |
| Residue Fraction (boiling above 538° C.) | * | |
| UV Aromatics, wt % of fraction | | 33.39 |
| Mono, wt % of fraction | * | 5.11 |
| Di, wt % of fraction | * | 4.04 |
| Tri, wt % of fraction | * | 7.70 |
| Tetra, wt % of fraction | * | 16.53 |
| Hydrogen, wt % of refraction | * | 8.83 |
| Carbon, wt % of fraction | * | 84.33 |
| Sulfur, wt % of fraction | * | 6.7840 |
| Nitrogen, wt % of fraction | * | 0.8419 |

* Not Determined

The invention claimed is:

1. A hydrocarbon composition, comprising:

a Ni/Fe/V content of between 100 wtppm and 300 wtppm as determined by ASTM Method D5708;

at least 0.15 grams of residue per gram as determined by ASTM Method D5307;

at least 0.2 grams of hydrocarbons having a boiling range distribution between 204° C. and 343° C. at 0.101 MPa per gram as determined by ASTM Method D5307;

at least 0.3 grams of hydrocarbons of a vacuum gas oil ("VGO") portion having a boiling range distribution between 343° C. and 538° C. at 0.101 MPA per gram, wherein the VGO fraction comprises at least 0.2 grams of total UV aromatics per gram of the VGO fraction; and wherein the hydrocarbon composition has a viscosity at 37.8° C. of at most 100 cSt, wherein viscosity is as determined by ASTM Method D445.

* * * * *